US008346147B2

(12) United States Patent
Yagi et al.

(10) Patent No.: US 8,346,147 B2
(45) Date of Patent: Jan. 1, 2013

(54) FIXING UNIT AND IMAGE FORMING APPARATUS

(75) Inventors: Motoyuki Yagi, Saitama (JP); Yasuki Tanaka, Saitama (JP); Yoshiyasu Tanioka, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 388 days.

(21) Appl. No.: 12/706,790

(22) Filed: Feb. 17, 2010

(65) Prior Publication Data

US 2010/0284715 A1 Nov. 11, 2010

(30) Foreign Application Priority Data

May 7, 2009 (JP) ..... 2009-112835

(51) Int. Cl.
*G03G 15/20* (2006.01)

(52) U.S. Cl. ..... 399/329

(58) Field of Classification Search ..... 399/328–330, 399/322

See application file for complete search history.

(56) References Cited

U.S. PATENT DOCUMENTS

| | | | | |
|---|---|---|---|---|
| 5,666,624 | A * | 9/1997 | Kanesawa et al. | 399/329 |
| 5,999,788 | A | 12/1999 | Kanesawa et al. | |
| 7,962,084 | B2 * | 6/2011 | Tanaka et al. | 399/329 |
| 2006/0257180 | A1 * | 11/2006 | Nakagawa et al. | 399/329 |
| 2007/0212135 | A1 * | 9/2007 | Suenaga | 399/329 |
| 2008/0003006 | A1 * | 1/2008 | Tsukamura et al. | 399/67 |
| 2008/0013323 | A1 | 1/2008 | Katsumoto et al. | |
| 2008/0292377 | A1 * | 11/2008 | Nakajima | 399/331 |

FOREIGN PATENT DOCUMENTS

| | | | |
|---|---|---|---|
| EP | 0470860 | B1 | 11/1996 |
| JP | 06-342248 | A | 12/1994 |
| JP | 07-140819 | A | 6/1995 |
| JP | 11-133776 | A | 5/1999 |
| JP | 2001-356625 | A | 12/2001 |
| JP | 2002-207389 | A | 7/2002 |
| JP | 2004-205620 | A | 7/2004 |
| JP | 2008-003232 | A | 1/2008 |
| JP | 2008-233133 | A | 10/2008 |

* cited by examiner

*Primary Examiner* — Walter L Lindsay, Jr.
*Assistant Examiner* — Rodney Bonnette
(74) *Attorney, Agent, or Firm* — Sughrue Mion, PLLC

(57) ABSTRACT

A fixing unit includes a heating roll, an endless belt and a pressing body having a hard pressing member and a soft pressing member. The hard pressing member is placed on a downstream of a passage direction of a record medium in a press contact part and forms higher hardness than an elastic layer of the heating roll. The soft pressing member is placed on an upstream of the passage direction from the hard pressing member, and forms lower hardness than the elastic layer. The press contact part is formed in a state in which a first press contact portion of the hard pressing member is longer than a second press contact portion of the soft pressing member. The hard pressing member has an end part opposed to the heating roll on the upstream. The end part has a face approaching the heating roll from the upstream to the downstream.

4 Claims, 21 Drawing Sheets

FIG. 14

| | EXAMPLE | | | | | | | | | | | | COMPARISON EXAMPLE | | | |
|---|---|---|---|---|---|---|---|---|---|---|---|---|---|---|---|---|
| SLOPE | R1.0 | | | | R0.5 | | | | C0.5 | | | | NONE | | | |
| CONVEYING STATE | AD | | D | | AD | | D | | AD | | D | | AD | | D | |
| NUMBER OF TIMES | ONE | TWO | ONE | TWO | ONE | TWO | ONE | TWO | ONE | TWO | ONE | TWO | ONE | TWO | ONE | TWO |
| SHIFT AMOUNT (mm) | -0.2 | -0.1 | -0.3 | -0.3 | -0.7 | -0.5 | -0.6 | -0.6 | -0.6 | -0.8 | -1.0 | -1.0 | -1.0 | -1.0 | -0.7 | -1.0 |

FIG. 15

| | EXAMPLE | | | | | | | | | | | | COMPARISON EXAMPLE | | | |
|---|---|---|---|---|---|---|---|---|---|---|---|---|---|---|---|---|
| SLOPE | R1.0 | | | | R0.5 | | | | C0.5 | | | | NONE | | | |
| CONVEYING STATE | AD | | D | | AD | | D | | AD | | D | | AD | | D | |
| NUMBER OF TIMES | ONE | TWO | ONE | TWO | ONE | TWO | ONE | TWO | ONE | TWO | ONE | TWO | ONE | TWO | ONE | TWO |
| SURFACE SHIFT (mm) | -0.7 | -0.1 | 1.0 | -0.1 | 1.0 | 0.6 | 1.2 | 1.5 | 1.0 | 1.3 | 1.5 | 2.0 | 2.0 | 2.0 | 2.0 | 2.0 |
| BACK SHIFT (mm) | -1.0 | -0.5 | -0.2 | -0.5 | -0.2 | -0.5 | -0.5 | -0.2 | -0.2 | -0.3 | -0.4 | -0.4 | -0.5 | -0.5 | -0.5 | -0.7 |

FIXING UNIT AND IMAGE FORMING APPARATUS

CROSS-REFERENCE TO RELATED APPLICATION

This application is based on and claims priority under 35 USC 119 from Japanese Patent Application No. 2009-112835 filed on May 7, 2009.

BACKGROUND

1. Technical Field

This invention relates to a fixing unit and an image forming apparatus.

2. Related Art

In an image forming apparatus of a printer, a copier, a facsimile, etc., an unfixed image developed in a developer and formed is transferred to a record medium of a sheet of paper, etc., and the transferred unfixed image is heated, pressed, and fixed on the record medium in a fixing unit, thereby forming an image of a character, a pattern, a design, a photo image, etc.

As a fixing unit used with the image forming apparatus, the following belt fixing unit exists: This belt fixing unit includes a heat rotation body of a roll form, etc., heated by heating means and rotated, an endless belt for coming in contact with the outer peripheral surface portion along the rotation axis direction of the heat rotation body for rotation, and a pressing member for pressing the endless belt against the outer peripheral surface portion of the heat rotation body to form a press contact part for allowing the record medium with the unfixed image held thereon to pass through the nip (press contact part) between the heat rotation body and the endless belt.

In this type of belt fixing unit, the record medium with the unfixed image held thereon is introduced and is allowed to pass through the press contact part formed between the heat rotation body and the endless belt, whereby the unfixed image is heated, pressed, and fixed on the record medium.

SUMMARY

According to an aspect of the invention, a fixing unit includes a heating roll, an endless belt and a pressing body. The heating roll includes an elastic layer and heated with a heat. The endless belt is in contact with an outer peripheral surface of the heating roll and rotates. The pressing body presses the endless belt against the outer peripheral surface of the heating roll from an inner peripheral surface side of the endless belt to form a press contact part. The press contact part allows a record medium holding an unfixed image to pass through between the endless belt and the heating roll. The pressing body includes a hard pressing member and a soft pressing member. The hard pressing member is placed on a downstream side of a passage direction of the record medium in the press contact part and forms higher hardness than the elastic layer of the heating roll. The soft pressing member is placed on an upstream side of the passage direction from the hard pressing member. The soft pressing member forms lower hardness than the elastic layer of the heating roll, and is elastically deformed. The hard pressing member has a first press contact portion in the press contact part. The soft pressing member has a second press contact portion in the press contact part. The press contact part is formed in a state in which the first press contact portion is longer than the second press contact portion. The hard pressing member has an end part opposed to the heating roll on the upstream side. The end part has a face approaching the heating roll from the upstream side to the downstream side.

BRIEF DESCRIPTION OF THE DRAWINGS

Exemplary embodiments of the invention will be described in detail based on the following figures, wherein:

FIG. 14 is a table to show the result of evaluation test 1;

FIG. 15 is a table to show the result of evaluation test 2;

DETAILED DESCRIPTION

Figure 1:
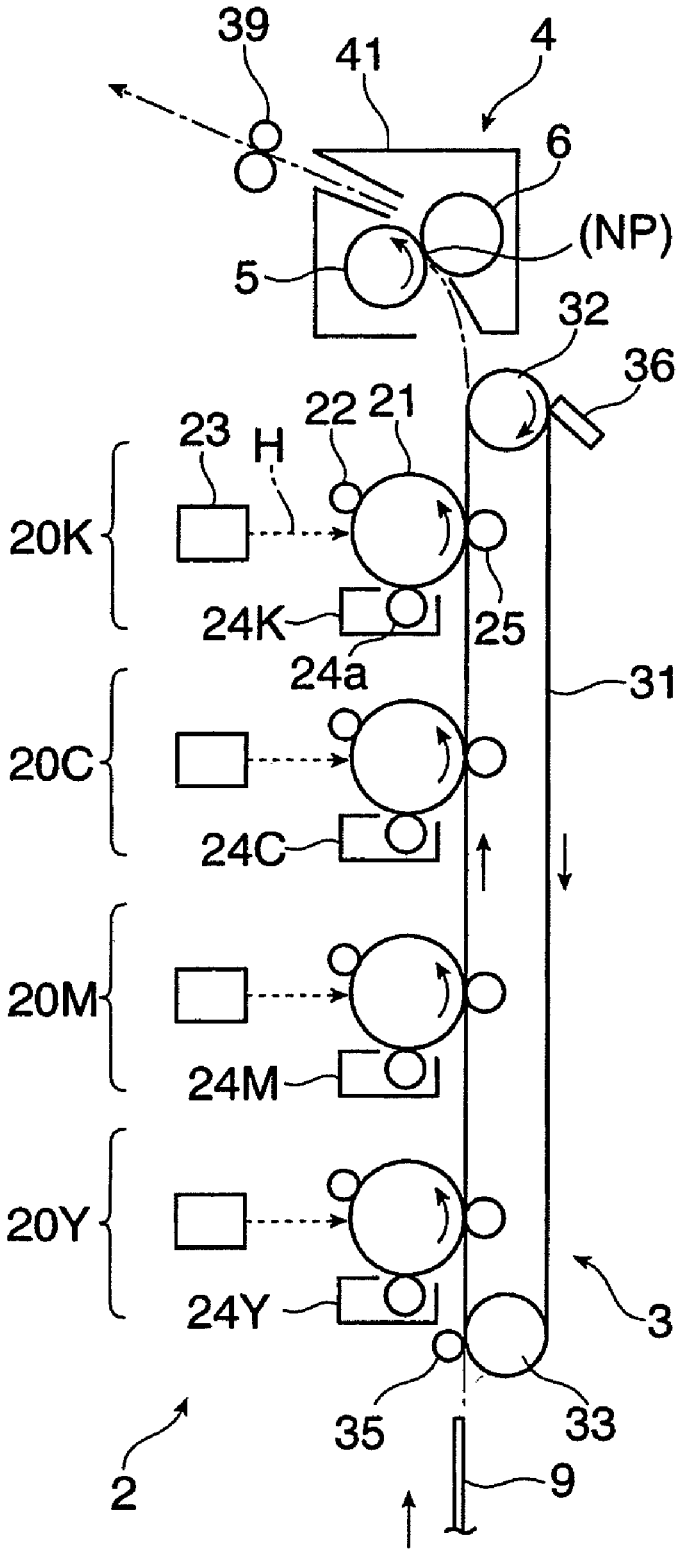
FIG. 1 is a schematic representation to show an outline of a fixing unit and an image forming apparatus according to an embodiment of the invention.

The mode for carrying out the invention (embodiment) will be discussed below with reference to the accompanying drawings:

An image forming apparatus 1 is implemented as a color printer for forming a multicolor image or a single-color image (monochrome image, etc.,), for example. It has a cabinet (not shown) containing an internal space wherein mainly installed are an imaging apparatus 2 for forming a toner image developed in toner (colored impalpable powder, etc.,) as a dry developer based on input image data and transferring the toner image to a record medium 9 to form an image finally, a sheet conveying unit 3 for conveying the record medium 9 to as to allow the record medium 9 to pass through the transfer positions of the imaging apparatus 2, and a fixing unit 4 for allowing the record medium 9 to which the toner image has been transferred to pass through and fixing the toner image, as shown in FIG. 1. The alternate long and short dash line with an arrow in the figure indicates a main conveying path of the record medium 9.

The imaging apparatus 2 is made up of four imaging units 20Y, 20M, 20C, and 20K for forming toner images of four colors of yellow (Y), magenta (M), cyan (C), and black (K) respectively using a known recording system of electrophotography, etc., for example. The four imaging units 20 (Y, M, C, and K) are placed as they are arranged linearly, for example.

Each of the imaging units (20Y, 20M, 20C, and 20K) includes a photoconductive drum 21 for basically rotating in the direction indicated by the arrow (in the figure, counterclockwise) and has the following main devices surrounding the photoconductive drum 21: A charging device 22 for charging the surface (image holding face) of the photoconductive drum 21 to a required potential, an exposure device 23 for applying light H based on separated components of the four colors of image data (signal) to the surface of the post-charged photoconductive drum 21 to form an electrostatic latent image (of each color component) having a potential difference, a developing device 24 (Y, M, C, K) for developing the electrostatic latent image of each color component in toner of the color (Y, M, C, K) corresponding to the color component to form a toner image, a transfer device 25 including a transfer roll, etc., for transferring the toner image to the record medium 9 conveyed by (a sheet conveying belt 31) of the sheet conveying unit 3, and the like.

For example, the photoconductive drum 21 has a grounded cylindrical base body having a periphery formed with an image holding face having a photosensitive layer (a photoconductive layer) made of an organic photosensitive material. Used as the charging device 22 is a charging device of a contract charging system for applying a charge voltage to a charging roll for coming in contact with the surface of the photoconductive drum 21 and rotating for charging. As the exposure device 23, a device implemented as an LED (light emitting diode) record head, a semiconductor laser scanner, etc., is used. Image information input from an external machine of an image creation source such as an image reader or a storage medium reader equipped with or connected (or wirelessly connected) to the image forming apparatus 1 or a computer, etc., is subjected to required processing by an image processing apparatus (not shown) and then an image signal provided by performing the processing is input to the exposure device 23.

As the developing device 24, a developer containing predetermined color toner (mono component developer, dual-component developer, etc.,) is supplied to the surface of the photoconductive drum 21 by the conveying force of a developing roll 24*a* in a state in which the developer is charged to a required polarity. A developing voltage is applied to the nip between the developing roll 24*a* and the photoconductive drum 21. Used as the transfer device 25 is a transfer device of a contact system for applying a transfer voltage to the transfer roll for coming in contact with the surface of the photoconductive drum 21 and rotating for transferring.

The sheet conveying unit 3 is mainly made up of a sheet conveying belt 31 for turning and circulating in the direction indicated by the arrow (clockwise in the figure) while passing through the nips between the photoconductive drums 21 and the transfer devices 25 of the imaging apparatus 2 (imaging units 20), a plurality of support rolls 32 and 33 on which the sheet conveying belt 31 is placed in any desired state for supporting the sheet conveying belt 31 for turning, an attracting roll 35 for electrostatically attracting the record medium 9 supplied one sheet at a time from a sheet feed unit (not shown) onto the outer peripheral surface of the sheet conveying belt 31, and a belt cleaning device 36 for removing deposits of unnecessary toner, paper dust, etc., deposited on the outer peripheral surface of the sheet conveying belt 31. A required voltage for giving a charge for electrostatically attracting the record medium 9 onto the sheet conveying belt 31 is applied to the attracting roll 35.

The sheet conveying belt 31 is provided by molding an endless belt form of a predetermined thickness using a material having a predetermined amount of a resistance adjustment agent of carbon, etc., dispersed in a synthetic resin of polyimide resin, polyamide resin, etc., for example. The support roll 32 is implemented as a drive roll and is rotated by rotation power transmitted from a rotation drive containing a motor, etc., (not shown). A sheet attracting voltage is applied to the attracting roll 35 from a power unit (not shown) at the attracting timing of the sheet 9.

The fixing unit 4 has a cabinet 41 in which a heating rotation body 5 of a roll form heated so as to hold the surface temperature at a predetermined temperature by heating means and rotating in the direction indicated by the arrow and a pressing rotation body 6 of a belt form for coming in contact with the surface portion of the heating rotation body 5 almost along the rotation axis direction thereof at a predetermined pressure to form a press contact part (fixing treatment part) NP and rotating are installed. Numeral 39 in FIG. 1 denotes a discharge roll pair for discharging the record medium 9 onto which an image has been fixed from the fixing unit 4. In the fixing unit 4, a conveying path where the record medium 9 is introduced, passes through the press contact part NP, and is discharged is a bend-shaped path drawing a locus so as to bend relative to the heating rotation body 5 side (letter C path). The fixing unit 4 is described later in detail.

The sheet feed unit is mainly made up of one or more storage cassettes for storing record media 9 of predetermined sizes, types, etc., to be supplied to the imaging apparatus 2 (the image units 20) as the record media 9 are stacked and a delivering unit for delivering and conveying the record media 9 stored in the storage cassette one sheet at a time. A conveying path for conveying the record medium 9 is formed between the sheet feed unit and the imaging apparatus 2. The record medium 9 is not limited if it can be conveyed in the image forming apparatus and a toner image can be transferred to the record medium 9; mainly, a record medium of a sheet form as a whole is used, such as a sheet of paper (ordinary paper, coated paper, etc.,), a cardboard, a transparent sheet, a postcard, or an envelope.

Basic image forming (print) of the image forming apparatus 1 is as follows: Here, the basic image forming operation for forming a full color image made up of toner images of the four colors (Y, M, C, and K) in combination on a single side of the record medium 9 will be discussed.

Upon reception of a print operation start command, in the image forming apparatus (in fact, controller) 1, the photoconductive drum 21 of the imaging unit 20 (Y, M, C, K) and the sheet conveying belt 31 of the sheet conveying unit 3 start to rotate and each charging device 22 in the imaging unit 20 charges the image holding face of each photoconductive drum 21 to the required polarity and potential. Subsequently, the exposure device 23 exposes the charged image holding face of the photoconductive drum 21 based on an image signal transmitted from the image processing apparatus (not shown), thereby forming an electrostatic latent image of each color component made of required potential difference on the image holding face of each photoconductive drum 21. Then, the developing device 24 supplies toner charged to the required polarity from the developing roll 24*a* and deposits the toner to develop the electrostatic latent image, thereby forming a toner image. The developing device 24 performs reversal development. Accordingly, the toner images of the color components (Y, M, C, and K) are formed on the photoconductive drums 21 of the imaging units 20 (Y, M, C, and K) respectively.

On the other hand, at the timing relating to the toner image forming operation, the record medium 9 of the required size, type, etc., is supplied from the sheet feed unit (not shown) to the sheet conveying unit 3 and is attracted onto the outer peripheral surface of the turning sheet conveying belt 31 upon reception of the electrostatic action from the attracting roll 35. Then, when the record medium 9 conveyed by the sheet conveying belt 31 passes through the transfer positions of the imaging units 20 (Y, M, C, and K), the toner images of the colors (Y, M, C, and K) on the photoconductive drums 21 in the imaging units 20 are transferred to the record medium 9 one after another in the order (Y, M, C, and K) as they are superposed upon reception of the action of an electric field formed in the transfer devices 25.

Subsequently, the record medium 9 to which the toner images have been transferred is peeled off from the sheet conveying belt 31 and then conveyed to and introduced into the fixing unit 4. When the record medium 9 to which the toner images have been transferred is allowed to pass through the press contact part NP between the heating rotation body 5 and the pressing rotation body 6, the fixing unit 4 heats and presses the record medium 9, thereby fusing the toner of the toner images and fixing the toner (toner image) onto the record medium 9. To form an image only on one side of the record medium 9, the record medium 9 with the image fixed thereon is discharged to a sheet discharge section (not shown) and is stored therein.

Accordingly, the basic print operation on one record medium 9 is complete. If a continuous print command of two or more sheets exists, the above-described operation sequence is repeated as many times as the specified number of sheets.

Next, the fixing unit 4 will be discussed in detail.

Figure 2:
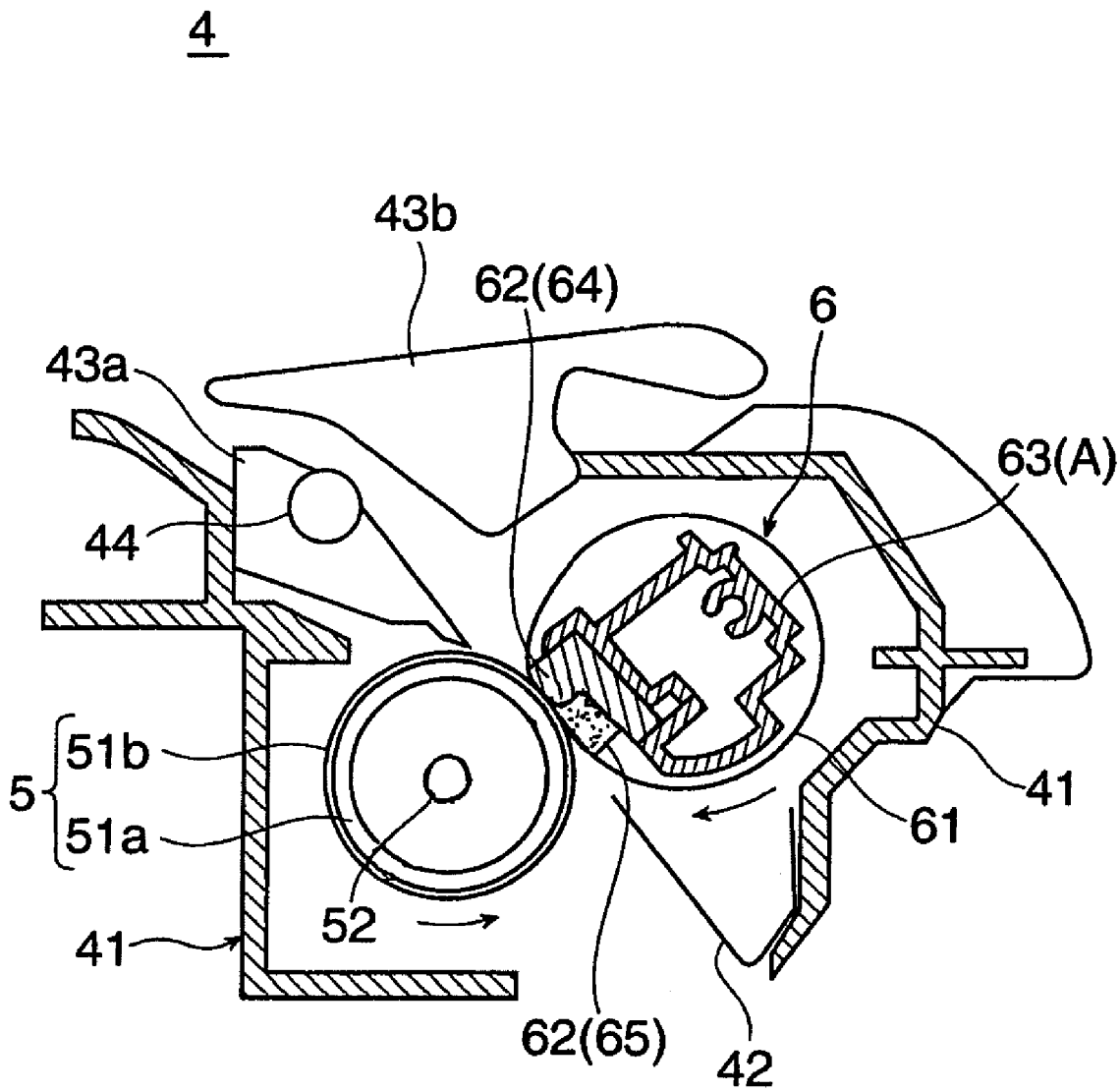
FIG. 2 is a fragmentary sectional view to show the main part of the fixing unit in FIG. 1.

The fixing unit 4 has the heating rotation body 5 of the roll form and the pressing rotation body 6 of the belt form installed in the cabinet 41 as shown in FIG. 2. In FIG. 2, numeral 42 denotes a conveying introduction plate for introducing the record medium 9 holding the toner images to be fixed into the press contact part NP. Numerals 43*a* and 43*b* denote conveying guide ribs for forming a discharge path. Numeral 44 denotes a conveying aid roller for rotating in a following manner in a direction aiding in the conveying property when the record medium 9 being conveyed through the sheet discharge comes in contact with the roller.

The heating rotation body 5 of the roll form is mainly made up of a heating roll 51, a heat source 52 for heating the heating roll 51, and a fix support frame (not shown) for supporting the heating roll 51 for rotation in both end parts of the heating roll 51.

An elastic layer 51*b* formed of a material of silicon rubber, etc., and a mold releasing layer formed of a material of fluorocarbon resin, etc., (not shown) are formed in order on the surface of a metal cylindrical roll base material 51*a* having a length larger than the maximum conveying width of the record media 9 introduced into the press contact part NP. Rotation power from a rotation drive section placed in the main body of the image forming apparatus 1 is transmitted to a gear attached to one end part of the heating roll 51, whereby the heating roll 51 is rotated at predetermined speed.

The heat source 52 is formed of a halogen lamp installed in the cylinder of the heating roll 51, for example, and both end parts of the halogen lamp are supported on the cabinet 41 of the fixing unit 4. Further, the temperature on the surface of the heating roll 51 is detected by a temperature detector (not shown) and the heating operation of the heat source 52 is controlled based on the detection information and accordingly the roll surface is kept in a state heated to the required temperature.

Figure 3:
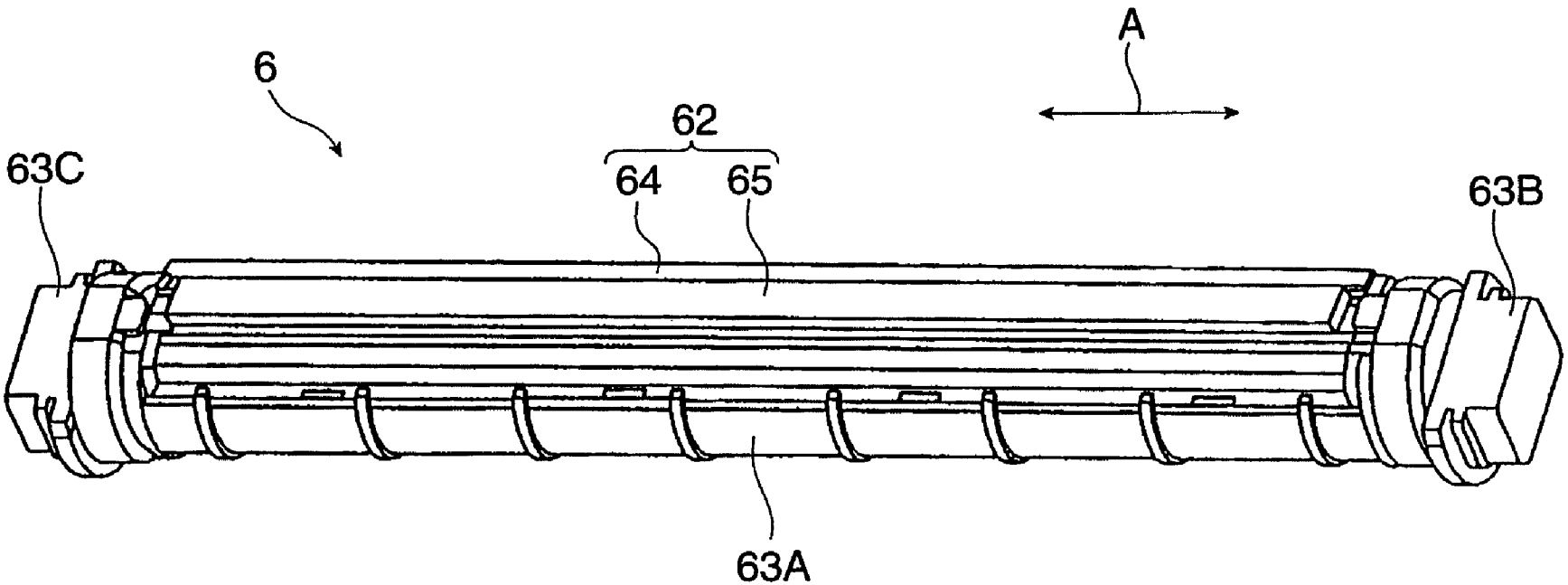
FIG. 3 is a perspective view to show a pressing rotation body (a part not shown) in the fixing unit in FIG. 2.

The pressing rotation body 6 of the belt form is mainly made up of an endless belt 61, a pressing body 62 and a retention body 63 as shown in FIGS. 2 to 5, etc. The endless belt 61 comes in contact with the outer peripheral surface portion along a rotation axis direction A of the heating roll 51 (see FIG. 3, etc.,) and rotating. The pressing body 62 presses the endless belt 61 against the outer peripheral surface portion of the heating roll 51 from the inner peripheral surface side of the endless belt 61 to form the press contact part NP. The retention body 63 placed in the internal space of the endless belt 61 supports the pressing body 62 and also retains the endless belt 61 for rotation. In FIG. 3, some of the components, such as the endless belt 61, are not shown.

The endless belt 61 is a cylindrical belt having the width of almost the same dimension as the length of the heating roll 51. Used as the endless belt 61 is a belt formed with a mold releasing layer made of fluorocarbon resin, etc., on the outer peripheral surface of the belt base material formed like a thin cylinder using a synthetic resin of polyimide, etc.

The pressing body 62 is made up of a head member 64 and a pad member 65 each of an elongated shape having almost the same length as the width of the endless belt 61, as shown in FIGS. 2 to 5, etc.

Figure 7:
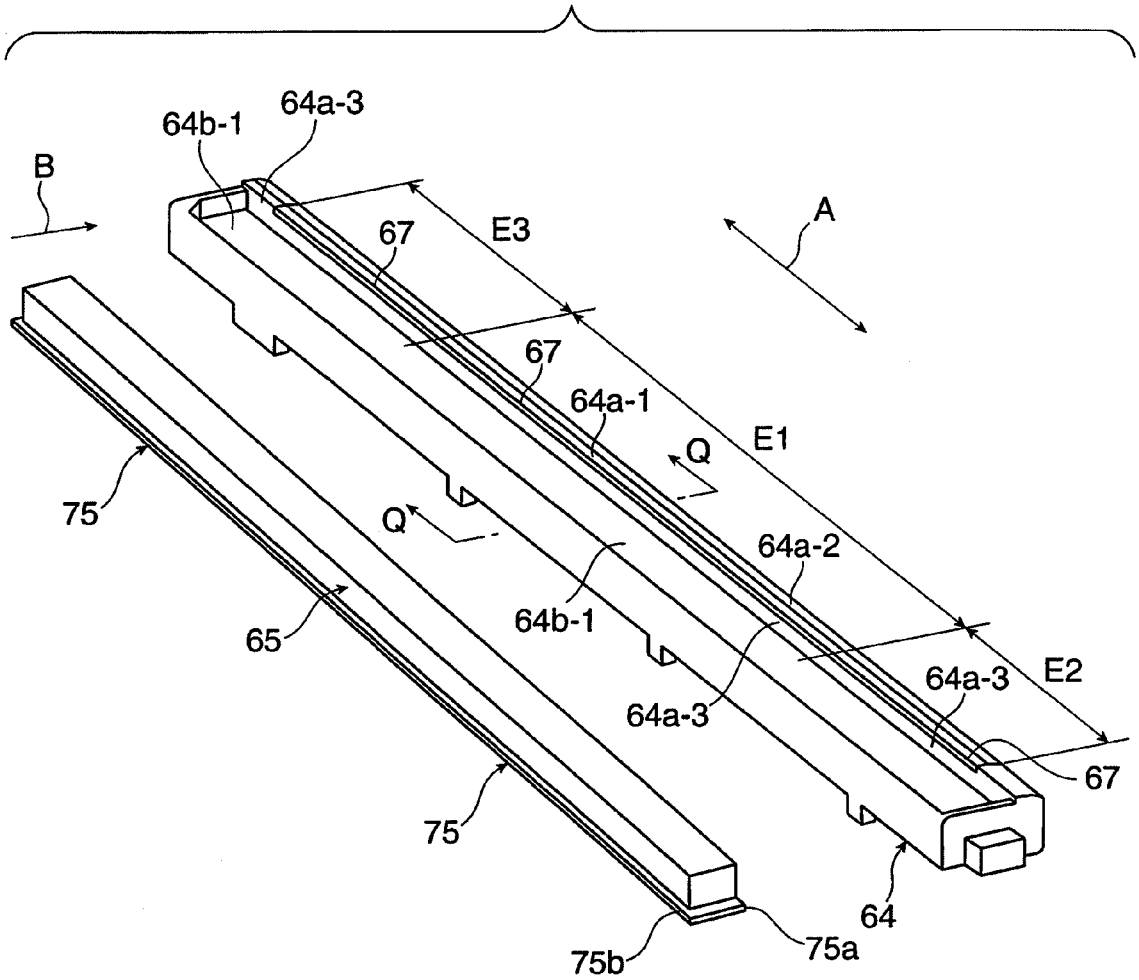
FIG. 7 is an exploded perspective view of the pressing body in FIG. 6.
Figure 8:
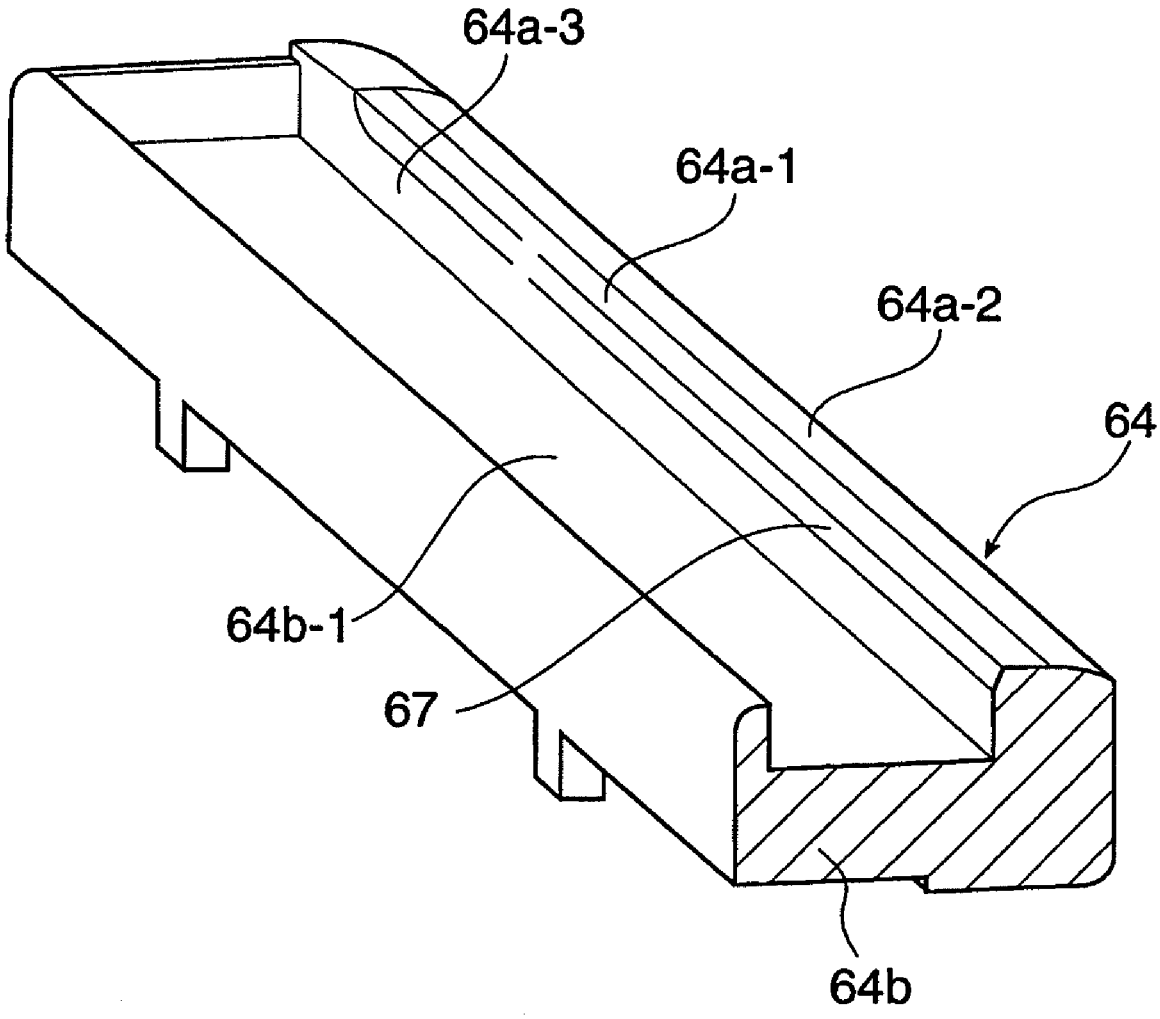
FIG. 8 is a sectional perspective view taken on line Q-Q of a head member in the pressing body in FIG. 7.
Figure 9:
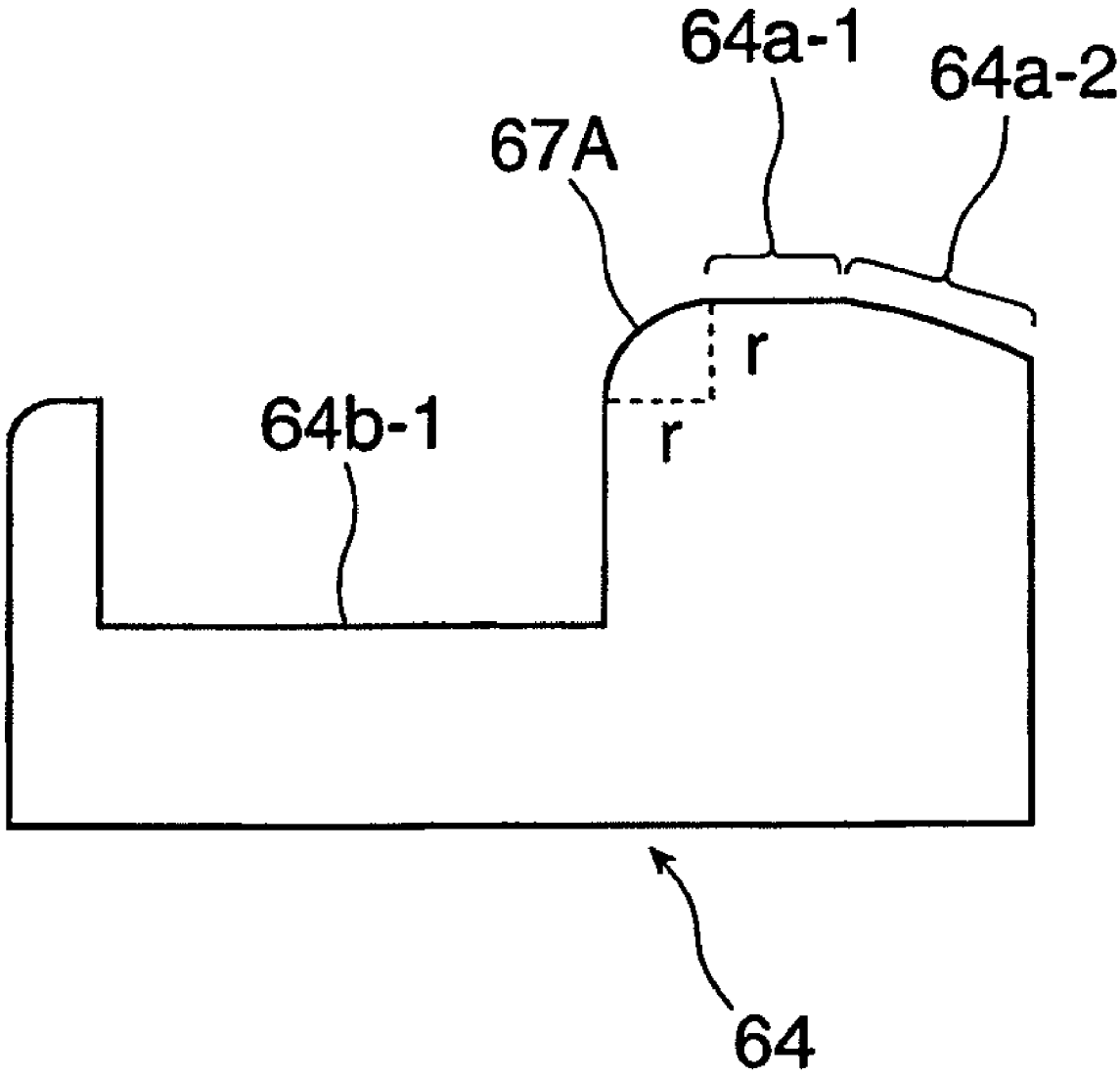
FIG. 9 is a schematic representation to show a configuration example of a slope formed in the head member.

The head member 64 is a hard pressing member formed of a material of a synthetic resin, metal, etc., and is placed at a downstream position (the discharge side of the record medium) in a passage direction B of the record medium 9 of the press contact part NP. In the embodiment, the head member 64 is formed as a shape having a projection part 64*a* and a retention part 64*b*. The projection part 64*a* is positioned downstream in the passage direction B of the record medium 9 for bringing the endless belt 61 into press-contact with the outer peripheral surface of the heating roll 51. The retention part 64*b* is positioned upstream in the passage direction B of the record medium 9 for retaining the pad member 65 in an adjacent state. The projection part 64*a* is formed with a flat part 64*a*-1 and a bend slope 64*a*-2, as shown in FIGS. 7 to 9. The flat part 64*a*-1 retains the smoothness of the press contact part NP on the side of the retention part 64*b*. The bend slope 64*a*-2 is bent and inclined in a state away from the heating roll 51 as shifting downstream in the passage direction B of the record medium 9 on the opposite side to the retention part 64*b* of the flat part 64*a*-1.

The pad member 65 is a soft pressing member formed of an elastic material of a rubber material, etc., and is placed at an upstream position (the introduction side of the record medium) in the passage direction B of the record medium 9 of the press contact part NP. In the embodiment, the pad member 65 is formed as an elongated plate shape using silicon rubber.

The head member 64 of the hard pressing member is formed so as to become higher hardness than the elastic layer 51*b* of the heating roll 51. The pad member 65 of the soft pressing member is formed so as to become lower hardness than the elastic layer 51*b* of the heating roll 51 and also become elastically deformed. The hardness is represented by the difference between the deformation amounts in a pressed portion when the portion is pressed at a given pressure under the same condition.

Figure 4:
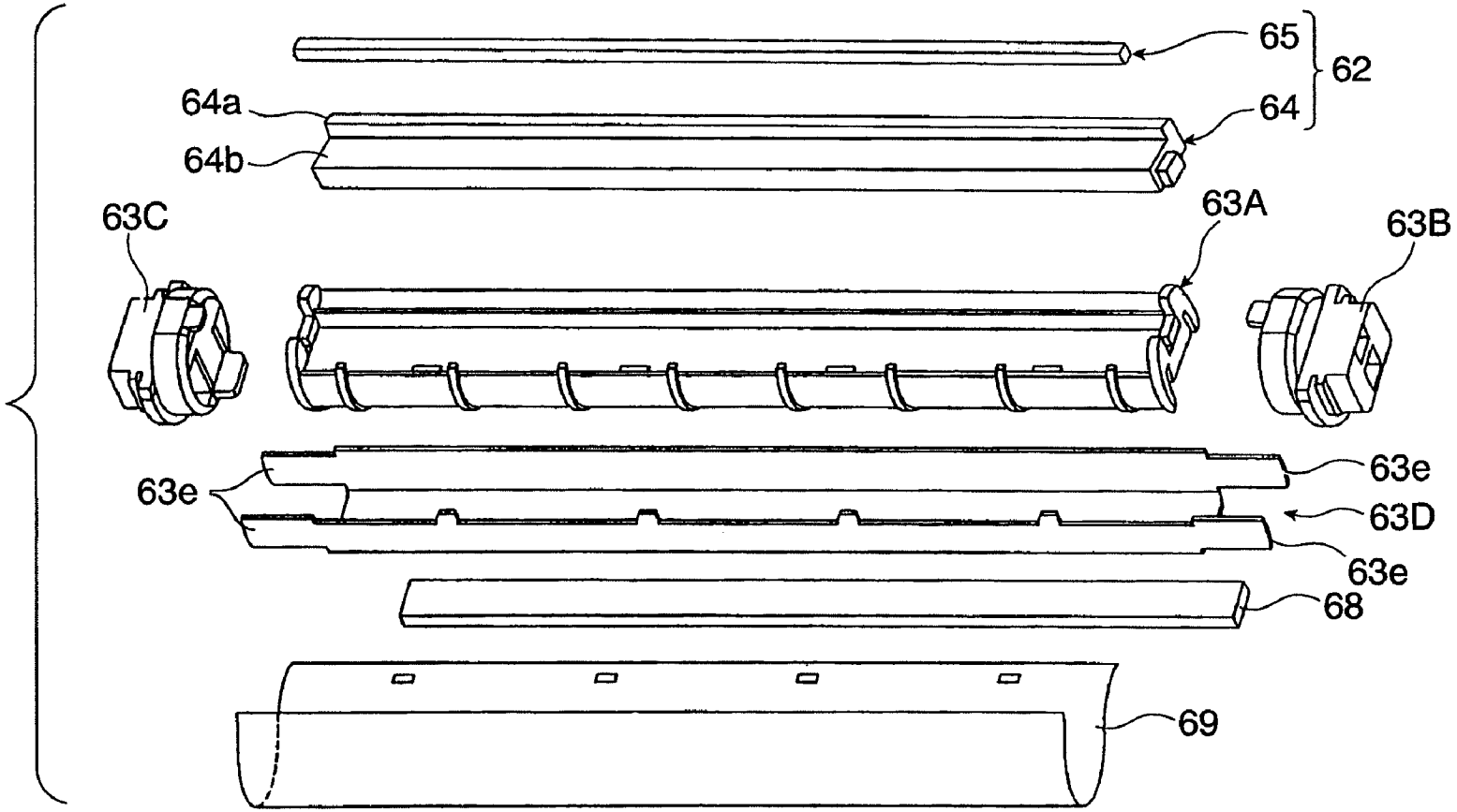
FIG. 4 is an exploded perspective view of the pressing rotation body in FIG. 3.

The retention body 63 includes an internal retention member 63A, a pair of end part retention members 63B and 63C, and a support plate 63D, as shown in FIGS. 2 to 4, etc. The internal retention member 63A has an installation plane portion for installing the pressing body 62 (in fact, the head member 64) and a belt retention member for retaining the inner peripheral surface of the endless belt 61 for rotation. The pair of end part retention members 63B and 63C retain the inner peripheral surface portions of both end parts of the endless belt 61. The support plate 63D supports the internal retention member 63A and the end part retention members 63B and 63C. The support plate 63D is retained in a state in which a pair of attachment end parts 63*e* formed projecting from both end parts of the support plate 63D is inserted into attachment holes formed in a rocking support frame 71 of the pressing rotation body 6 described later.

Numeral 68 in FIG. 4, etc., denotes an oil supply member attached to a back of the support plate 63D, etc., so as to come in contact with the inner peripheral surface of the endless belt 61. The oil supply member 68 is implemented as a felt member impregnated with mold releasing oil, for example, and supplies the mold releasing oil to the inner peripheral surface of the endless belt 41. Numeral 69 denotes a film member of a synthetic resin placed so as to intervene between the inner peripheral surface of the endless belt 61 and the pressing body 62 for lightening friction between the endless belt 61 and the pressing body 62.

Figure 5:
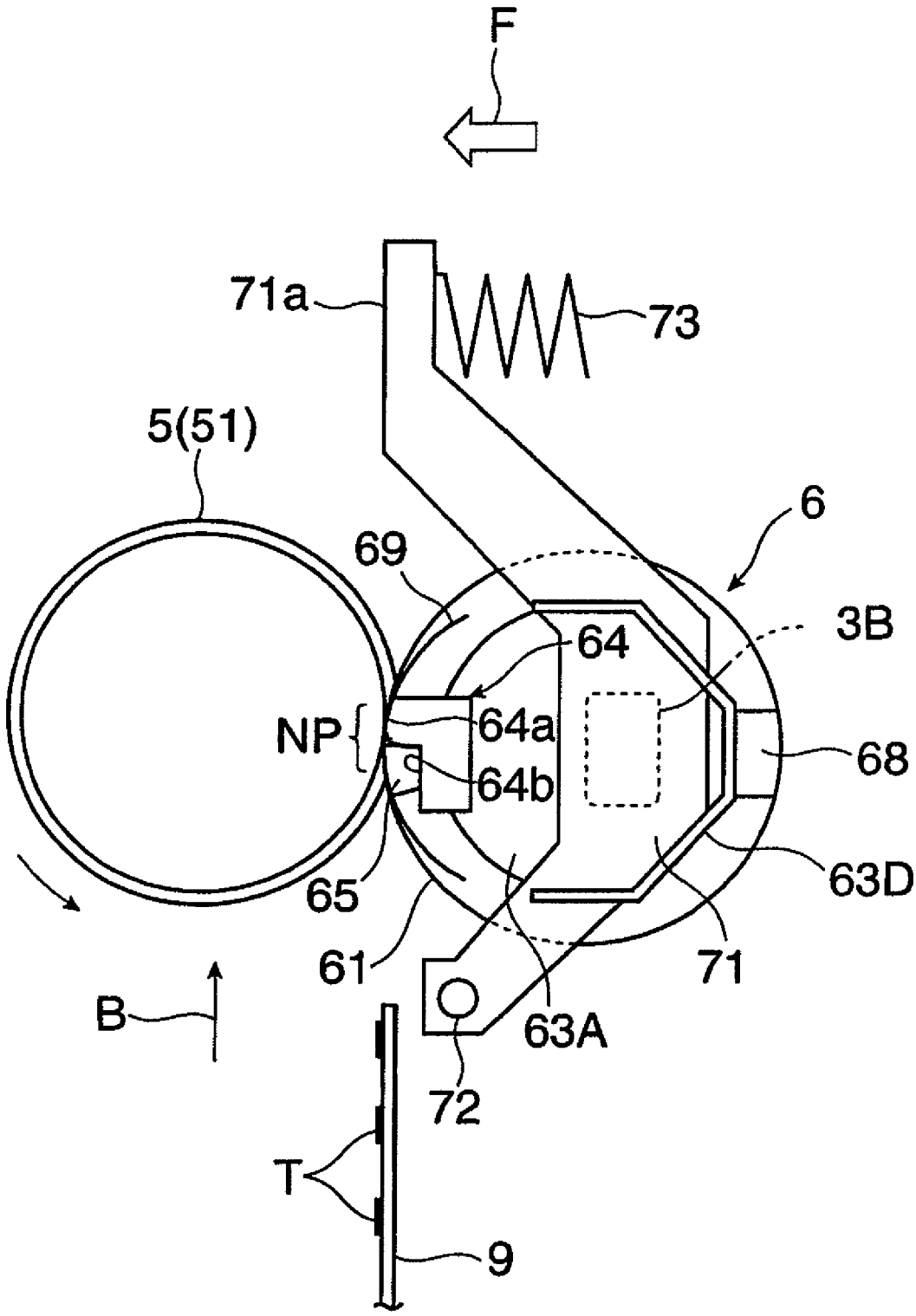
FIG. 5 is a schematic representation to show the main part of the fixing unit in FIG. 2.

The pressing rotation body 6 is held on (almost the center part of) the rocking support frame 71 rocking with a support shaft 72 placed at a position on the introduction side of the record medium as a supporting point as a whole through the support plate 63D of the retention body 63, as shown in FIG. 5. The pressing rotation body 6 is pressed so as to move in a direction approaching the heating rotation body 5 side by a required pressing force F of a pressing spring 73 connected to a free end part 71*a* of the rocking support frame 71. Accordingly, the pressing body 62 is pressed against the inner peripheral surface of the endless belt 61 through the retention body 63 and a required pressure is given to the press contact part NP.

In the fixing unit 4, the pressing body 62 presses the endless belt 61 against the outer peripheral surface of the heating roll 51, thereby forming the fixing press contact part NP where the endless belt 61 is in contact with the outer peripheral surface of the heating roll 51 with a required width (the length of the heating roll in the rotation direction thereof or the length of the record medium in the passage direction B thereof) between the heating roll 51 and the endless belt 61 (the pressing body 62), as shown in FIGS. 2 and 5. At this time, the press contact part NP is formed in a state in which both the head member 64 and the pad member 65 of the pressing body 62 are in contact with the outer peripheral surface of the heating roll 51 through the endless belt 61.

When the heating roll 51 rotates, the endless belt 61 turns in the direction indicated by the arrow following the rotation of the heating roll 51, as shown in FIG. 2. When the endless belt 61 turns, mold releasing oil is applied little by little to the inner peripheral surface of the endless belt 61 from the felt member 68, as shown in FIG. 5.

Fixing in the press contact part NP is as follows:

As shown in FIG. 5, when the record medium 9 holding an unfixed toner image T to be fixed is introduced into the press contact part NP, first the pad member 65 of the soft pressing member placed on the record medium introduction side of the press contact part NP presses the record medium 9 against the heating roll 51 (through the endless belt 61). Subsequently, (the contact part 64*a* of) the head member 64 of the hard pressing member placed on the record medium discharge side of the press contact part NP strongly presses the record medium 9 against the outer peripheral surface of the heating roll 51 (through the endless belt 61).

The record medium 9 holding the unfixed toner image at this time is heated in a state in which it is pressed against the outer peripheral surface of the heating roll 51 of the heating rotation body 5 by the pad member 65 and the head member 64 in the pressing body 62 of the pressing rotation body 6 in the press contact part NP, and is conveyed so as to pass through the press contact part NP with rotation of the heating roll 51. Consequently, when the record medium 9 passes through the press contact part NP, the unfixed toner image transferred to and held on the record medium 9 is heated and pressed, whereby the toner image is fixed onto the record medium 9.

By the way, in the image forming apparatus 1, as the record medium 9, a record medium represented by an envelope, etc., with concatenation of an end part 9*b* upstream in the passage direction B in the press contact part NP of the fixing unit 4 (which will be hereinafter also referred to simply as "bag-shaped record medium") 9A is used and the above-described image forming operation can also be executed for the bag-shaped record medium 9A to form an image.

Figure 20:
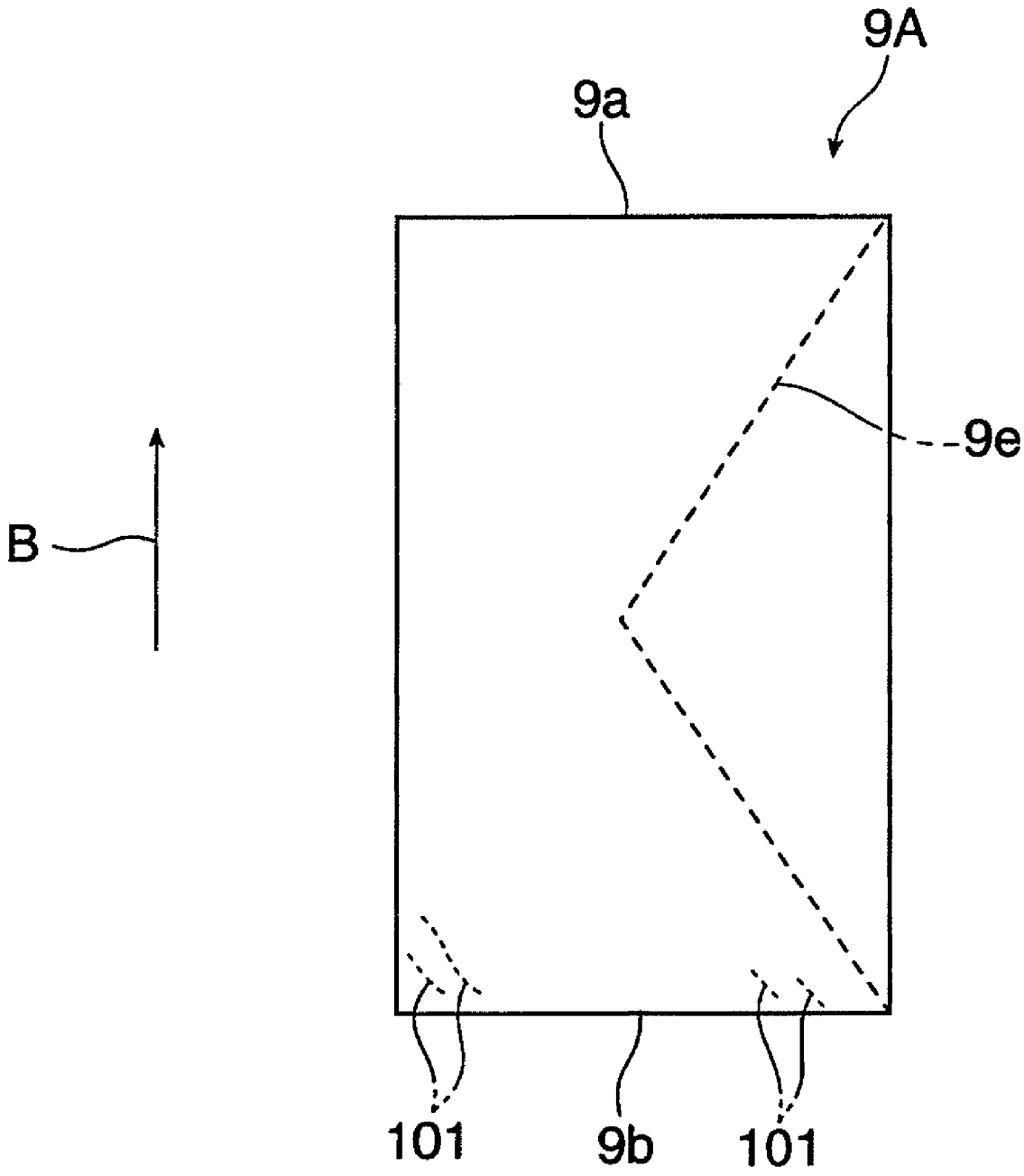
FIG. 20 is a schematic representation to show an example of an end part wrinkle occurring on a bag-shaped record medium.

However, to form an image on the bag-shaped record medium 9A, after the record medium passes through the press contact part NP of the fixing unit 4, an unnecessary wrinkle (which will be hereinafter also referred to as "end part wrinkle") 101 may occur in the trailing end part 9*b* upstream in the passage direction of the record medium 9A (see FIG. 20).

Figure 18:
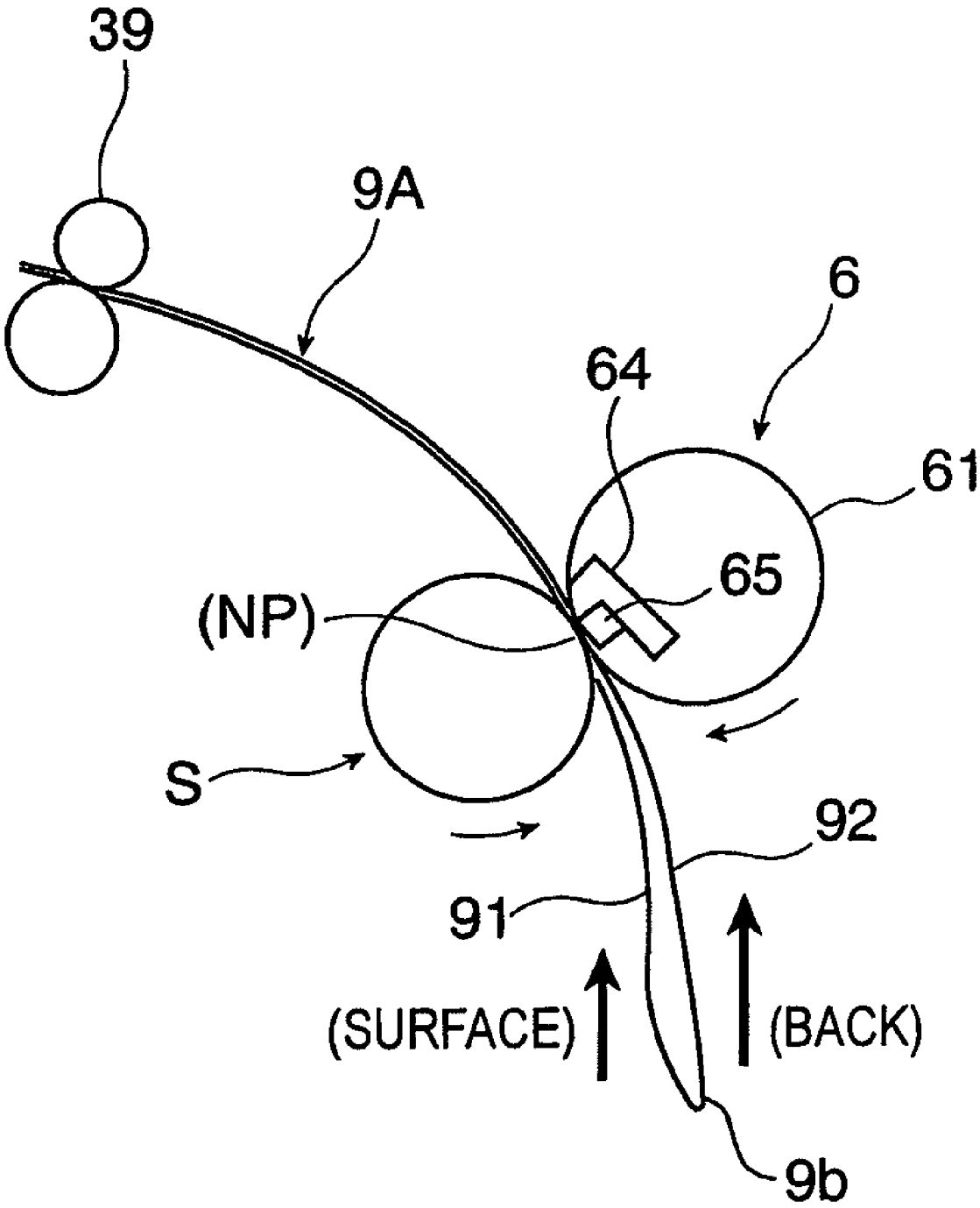
FIG. 18 is a schematic representation to show the cause of occurrence of a wrinkle on a bag-shaped record medium.

The wrinkle may occur as follows: For example, as shown in FIG. 18, the bag-shaped record medium 9A is introduced and passes through the press contact part NP between the heating roll 51 of the heating rotation body 5 and the pressing rotation body 6 of the belt form and then is discharged. At this time, the bag-shaped record medium 9A is conveyed in a bend state following the curvature of the cylindrical periphery in the outer peripheral surface portion of the heating roll 51 passing through the press contact part NP and thus a fine difference occurs in move (conveying) speed between a surface part (surface medium portion: Fix face) 91 and a back part (back medium portion) 92 in an overlap state as a bag-shaped form. This means that the move speed of the overlap portion at a distance from the heating roll 51 (the back part 92) becomes higher than the move speed of the portion close to the heating roll 51 (the surface part 91). Accordingly, slack occurs on the face where the move speed is relatively low (for example, the surface part 91) on the trailing end part 9*b* side of the envelope introduced later into the press contact part NP in the record medium 9A, and the slack portion is not lost in the record medium 9A, etc., and is crushed finally when passing through the press contact part NP to form a wrinkle.

Figure 19:
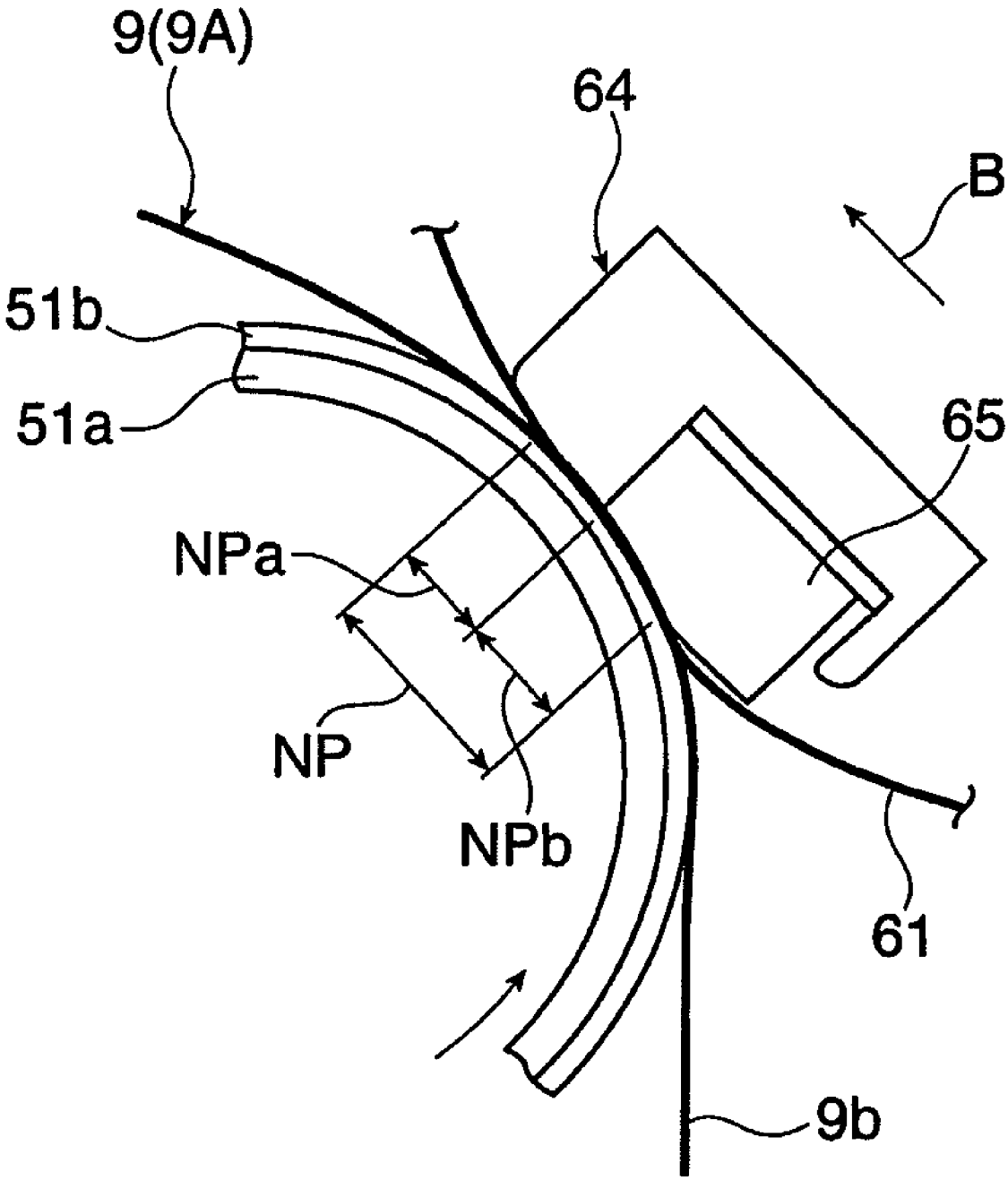
FIG. 19 is a schematic representation to show a state of a press contact part formed using a head member with no slope formed as a head member and a state of a record medium passing through the press contact part.

In a conventional fixing unit 1, as illustrated in FIG. 19, a press contact part NP is formed as a head member 64 and a pad member 65 of a pressing body 62 press (through an endless belt 61), but the length (width) of a press contact part portion NPb formed in the pad member 65 in a passage direction B of a record medium is longer than the length (width) of a press contact part portion NPa formed in the head member 64 in the passage direction B of the record medium. In the press contact part portion NPb formed in the pad member 65, the pad member 65 has lower hardness than an elastic layer 51*b* of a heating roll 51 and thus the portion coming in contact with the outer peripheral surface of the heating roll 51 of the pad member 65 (through the endless belt 61) becomes elastically deformed to a shape almost following the cylindrical periphery of the outer peripheral surface of the roll. On the other hand, in the press contact part portion NPa formed in the head member 64, the head member 64 has higher hardness than the elastic layer 51*b* of the heating roll 51 and thus the portion coming in contact with the head member 64 of the elastic layer 51*b* of the heating roll 51 (through the endless belt 61) becomes elastically deformed to a shape almost following the shape of the contract portion of the head member 64.

At the fixing time, the bag-shaped record medium 9A relatively much passes through the area portion elastically deformed almost following the shape of the cylindrical periphery of the outer peripheral surface of the heating roll 51 in the press contact part portion NPb formed in the pad member 65 with a larger length percentage in the press contact part NP. In this connection, as the shape of the portion through which the record medium passes in the press contact part NP has larger curvature corresponding to the outer peripheral surface of the heating roll 51, the move speed difference relative to the bag-shaped record medium 9A tends to become larger.

Figure 6:
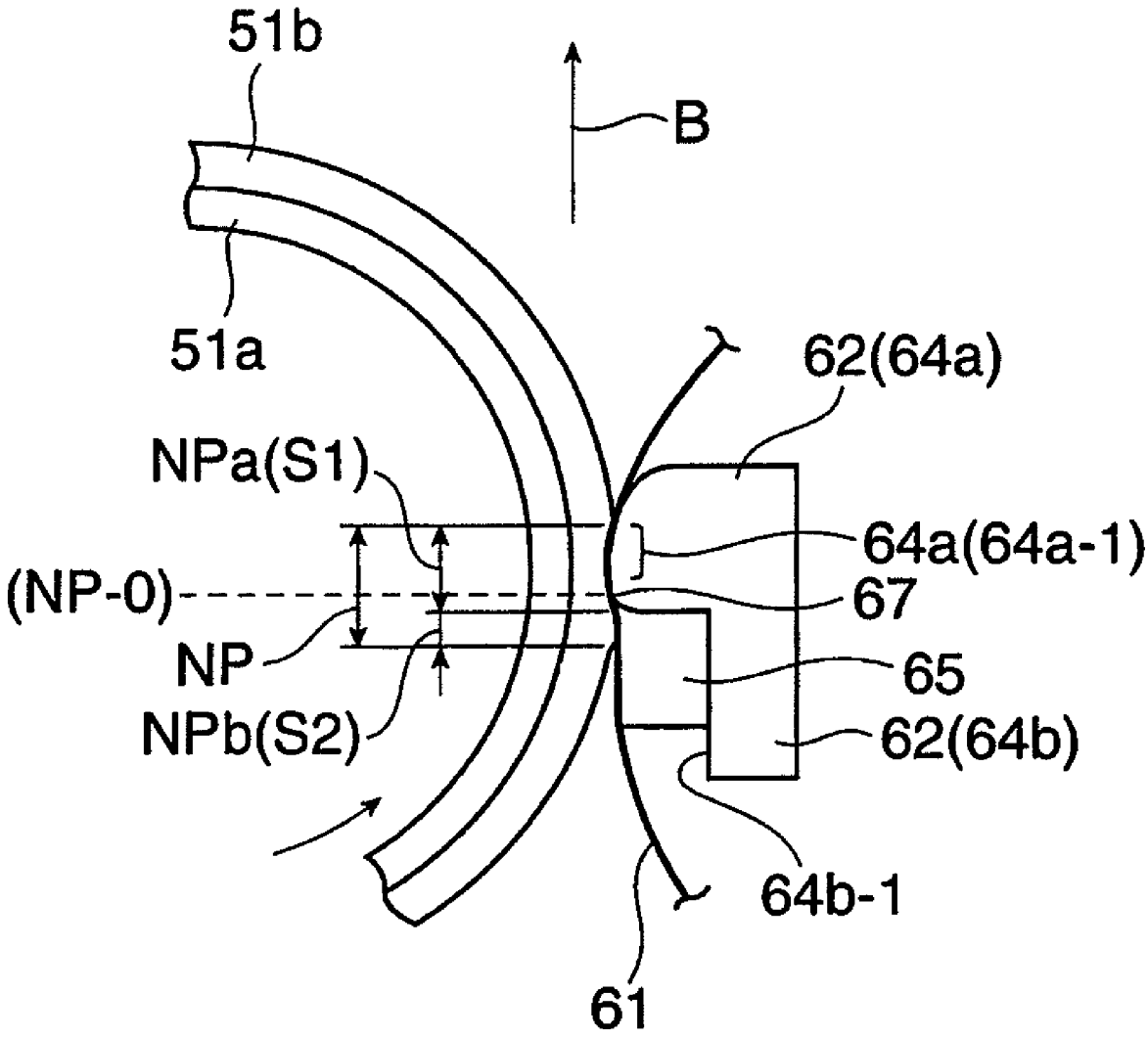
FIG. 6 is a schematic representation to show a state of a press contact part of a pressing body and its periphery in the fixing unit in FIG. 2.

Then, in the fixing unit 4 of the image forming apparatus 1, as measures to suppress occurrence of a wrinkle when the bag-shaped record medium 9A is used, the press contact part NP is configured as follows:

The press contact part NP in the fixing unit 4 is formed so that about a length S with respect to the passage direction B of the record medium 9, a length (S1) of the press contact part portion NPa formed in the head member 64 becomes longer than a length (S2) of the press contact part portion NPb formed in the pad member 65, as shown in FIG. 6, etc. In the head member 64 of the pressing body 62 forming the press contact part NP, the end part opposed to the heating roll 51 and upstream in the passage direction B of the record medium 9 is formed as a slope 67 approaching the heating roll 51 as it shifts downstream in the passage direction B, as shown in FIGS. 6 to 9, etc.

In the fixing unit 4, the above-mentioned configuration is adopted not only for a specific area portion (specific fix area) E1 to allow the bag-shaped record medium 9A to pass through, of a fix set area E in a rotation axis direction A of the heating roll 51 of the press contact part NP, but also for all area of the fix set area E (containing fix areas E2 and E3 described later). The specific fix area E1 corresponds to (the width) of a passage area in the press contact part NP where the bag-shaped record medium 9A passes through at the fixing time. To adopt a conveying system for regulating the conveying position of the record medium 9 with the center position of the fix set area E of the press contact part NP as the reference position at the conveying time in the fixing unit 4, namely, a center registration system, the ordinary fix areas E2 and E3 exist on both sides of the specific fix area E1 unless the feed width of the bag-shaped record medium 9A is the maximum size in the applicable record media 9 (see FIG. 7). In this connection, to adopt a conveying system for regulating the conveying position of the record medium 9 with the position of one end part of the fix set area E in the press contact part NP as the reference position at the conveying time in the fixing unit 4, namely, a side registration system, one end part of the specific fix area E1 is also defined as the reference position and the ordinary fix area (E2 or E3) may exist on the end part side opposite to the reference position.

In the embodiment, the length (S1) of the press contact part portion NPa may be made longer than the length (S2) of the press contact part portion NPb. However, if the ratio of the NPb length S2 to the NPa length S1 is too large, it becomes impossible to suppress occurrence of an unnecessary wrinkle and a defect such that the pressing force of the heating roll 51 becomes too large as the whole press contact part NP and the drive torque at the rotation time becomes excessive occurs.

To form the press contact part NP having the relationship of "S1>S2" as mentioned above for the lengths of the press contact part portions NPa and NPb, for example, the opposed position, the opposed attitude (angle), etc., of the pressing body 62 to the heating roll 51 may be adjusted. Further, the length S1 of the press contact part portion NPa and the length S2 of the press contact part portion NPb in the press contact part NP can be measured with a 3D measuring instrument, for example.

Figure 16:
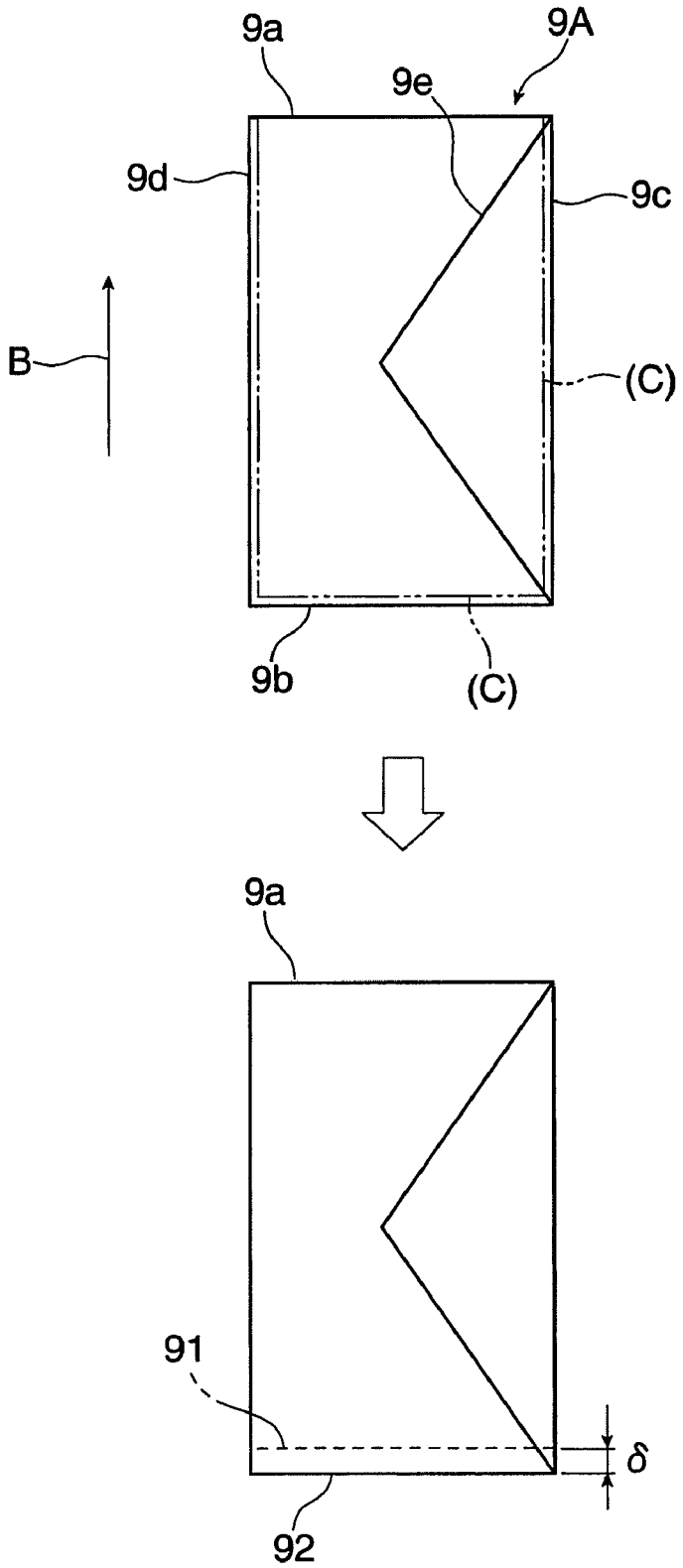
FIG. 16 is a schematic representation to show the work state of an envelope used in evaluation test 1 and measurement.

On the other hand, the shape of the surface of the slope 67 formed in the head member 64 is not limited if the surface approaches the heating roll 51 as it shifts downstream in the passage direction B of the record medium 9; it may be any face shape such as a flat face, a curved surface, or a polygonal face. However, preferably the face shape of the slope 67 is a curved surface projecting to the side of the heating roll 51 from the viewpoint of making it possible to lessen the move speed difference between the surface part 91 and the back part 92 in the bag-shaped record medium 9A (see FIG. 16) or the like.

Figure 13:
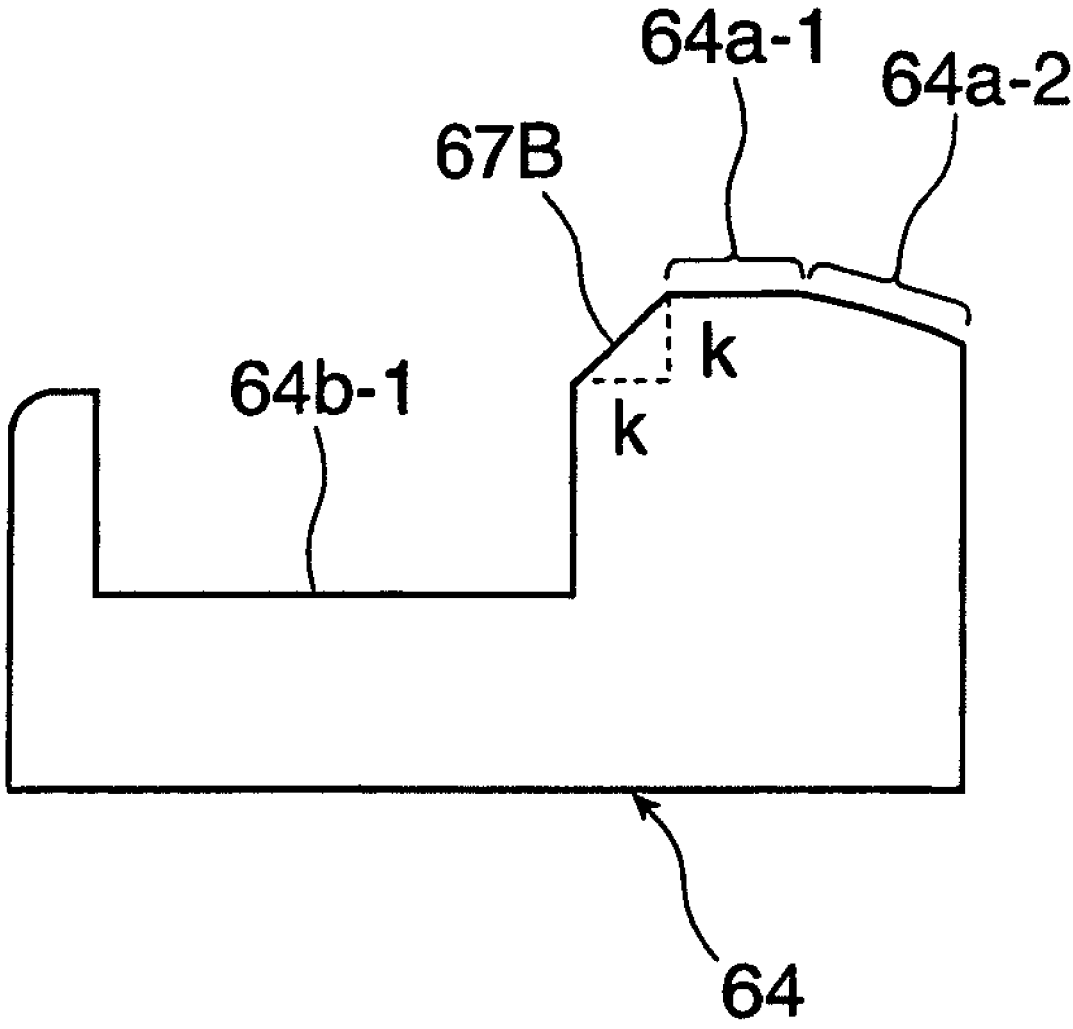
FIG. 13 is a schematic representation to show another configuration example of a slope formed in head member.

The size of the slope 67 slightly varies depending on the conditions of other components such as the whole length S of the press contact part NP and the outer diameter of the heating roll 51. For example, the slope 67 is a cylindrical face 67A of a quarter of a circle (cylinder) having a radius r in the range of 0.5 to 1.0 mm as shown in FIG. 9 or is a diagonal line (face) 67B of a quadrangle with the length of one side, k, in the range of 0.5 to 1.0 mm as shown in FIG. 13.

The pressing body 62 is completed by installing the pad member 65 on an installation face 64*b*-1 of the head member 64 formed with the slope 67 in a state in which the pad member is fixed by fixing means of adhesion, etc.

In the embodiment, to fix the pad member 65 onto the head member 64, the pad member 65 is attached to a support plate 75 having higher hardness than the pad member 65 in a fixed state, and the support plate 75 onto which the pad member 65 is fixed is installed on the installation face 64*b*-1 of the retention part 64*b* of the head member 64 for fixture, as shown in FIGS. 7, 10, etc. A hard plate made of a synthetic resin, a metal plate, etc., can be used as the support plate 75.

Figure 10A:
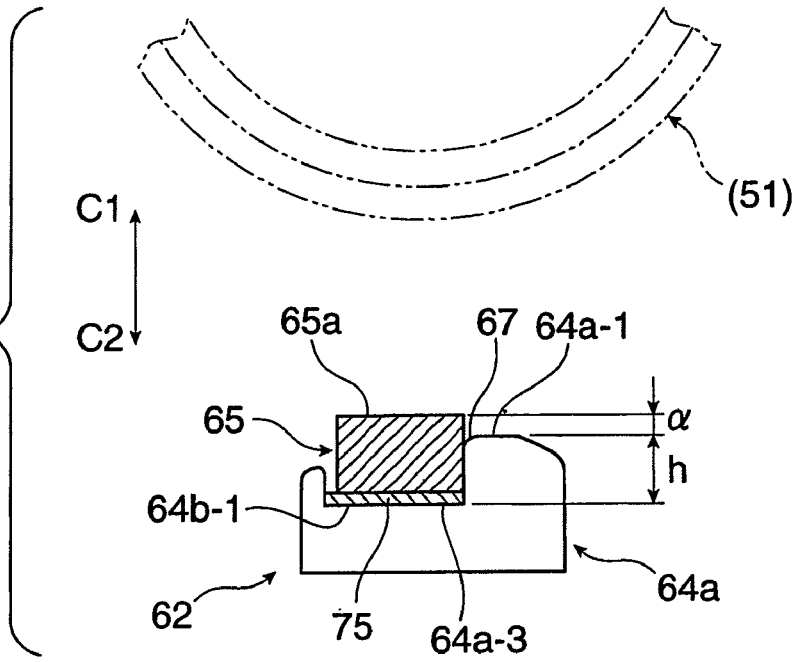
FIG. 10A is a schematic representation to show a state before the pressing body in FIG. 6 is assembled (when disassembled)

As for the pad member 65, as shown in FIG. 10A, when the pressing body 62 brings the endless belt 61 away from the outer peripheral surface of the heating roll 51 and does not form the press contact part NP, for example, at the timing before the pressing rotation body 6 is assembled or when it is disassembled, etc., a press contact face part 65*a* forming a part of the press contact part NP is projected so as to exist in a direction approaching the heating roll 51 (direction of arrow C1) rather than the surface portion closest to the heating roll 51 (flat part 64*a*-1 of projection part 64*a*) when forming the press contact part NP in the head member 64.

That is, the pad member 65 is formed to a thickness (height: Dimension from the installation face 64*b*-1) in a state in which the press contact face part 65*a* projects by required projection amount a from the flat part 64*a*-1 of the projection part 64*a* of the head member 64. Symbol h in FIG. 10A denotes the height of the flat part 64*a*-1 of the projection part 64*a* of the head member 64 from the installation face 64*b*-1. Thus, the pad member 65 is a member formed as the size as the thickness at least in a non-press state of the press contact face part 65*a* is larger than the height h of the flat part 64*a*-1 of the projection part 64*a* of the head member 64.

Figure 10B:
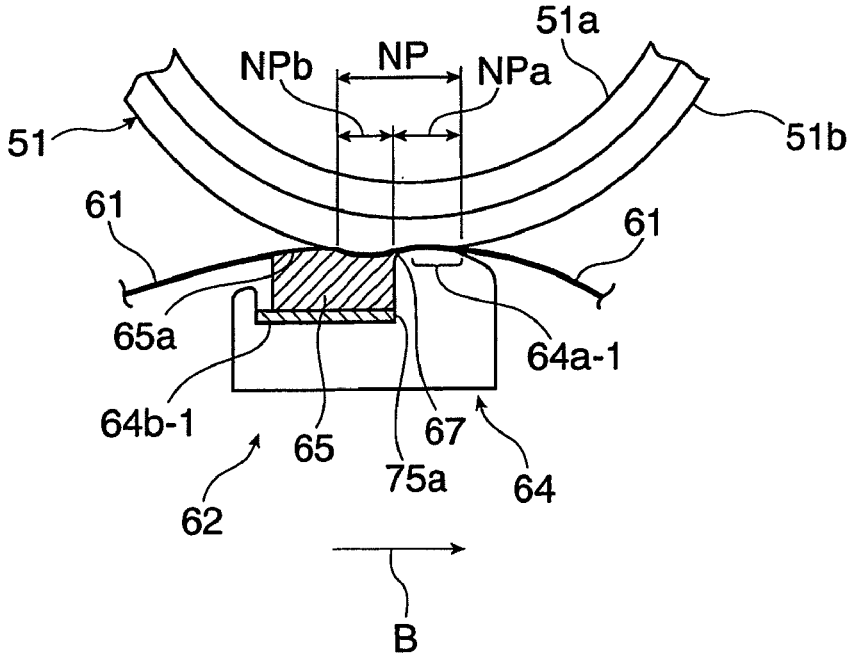
FIG. 10B is a schematic representation to show a state in which the pressing body is assembled and is pressed against a heating roll through an endless belt.

Moreover, when the pressing body 62 presses the endless belt 61 against the heating roll 51 to form the press contact part NP at the timing after the pressing rotation body 6 is assembled, etc., the pad member 65 becomes elastically deformed and is compressed so as to exist in a direction away from the heating roll 51 (direction of arrow C2) from the surface portion of the head member 64 (the flat part 64*a*-1 of the projection part 64*a*), as shown in FIG. 10B.

Particularly, the pad member 65 is formed of a soft member indicating lower hardness than the elastic layer 51*b* of the heating roll 51 and becoming elastically deformed as described above. Thus, when the pressing body 62 presses the endless belt 61 against the heating roll 51 to form the press contact part NP, the pad member 65 receives a reaction force from the elastic layer 51*b*, becomes elastically deformed, and is compressed. At this time, the projection part 64*a* of the head member 64 is formed with the slope 67 and tapers and thus the flat part 64*a*-1 of the projection part 64*a* much bites into the elastic layer 51*b*. Consequently, the press contact face part 65*a* of the pad member 65 exists in a direction away from the heating roll 51 from the flat part 64*a*-1 of the surface portion of the head member 64.

Figure 11:
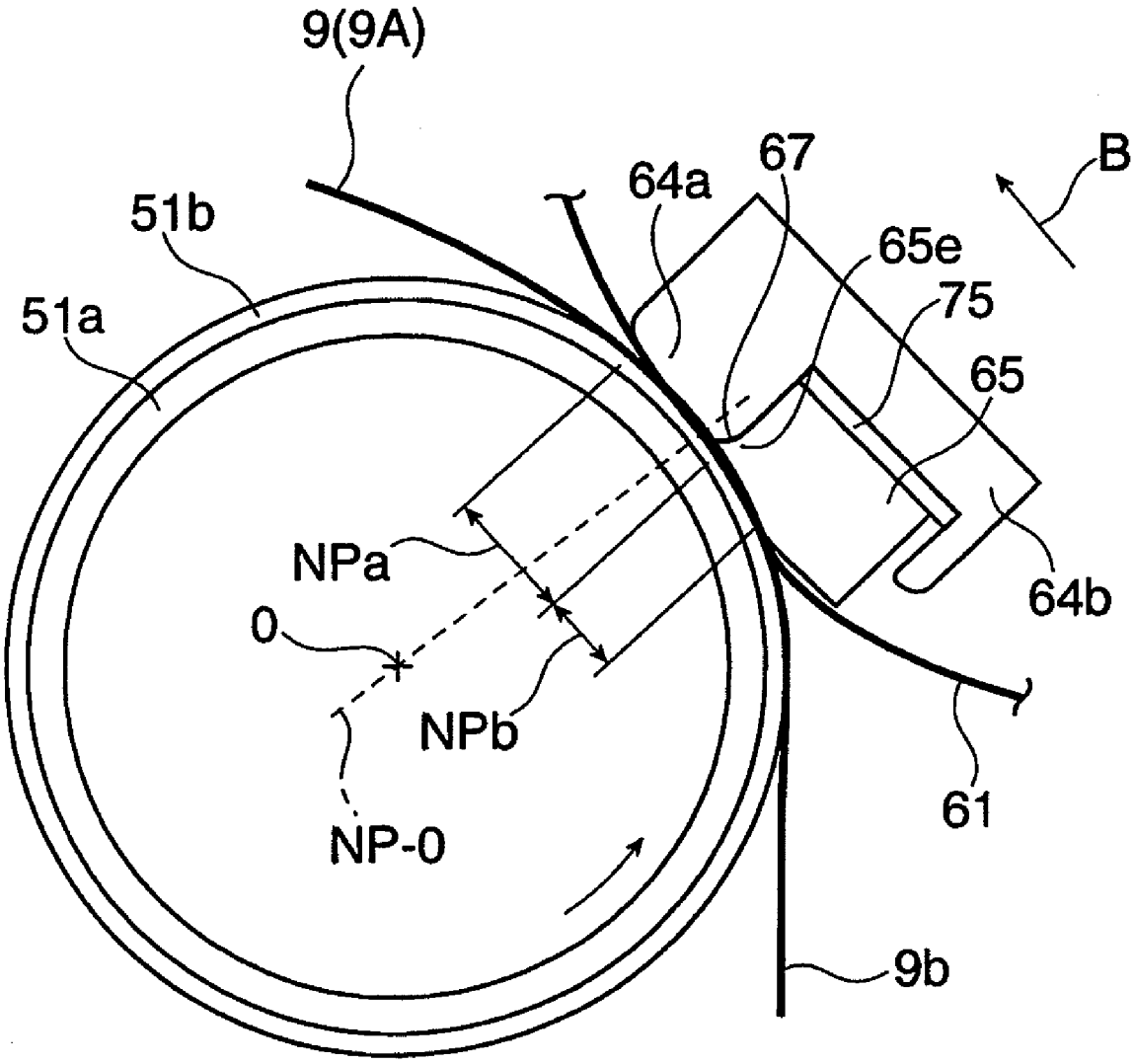
FIG. 11 is a schematic representation to show a state of the press contact part in FIG. 6 and a state of a bag-shaped record medium passing through the press contact part.

In the fixing unit 4, at the stage where the pressing rotation body 6 is assembled and is installed so as to form the press contact part between the heating roll 51 and the pressing rotation body 6, the projection part 64*a* of the head member 64 in the pressing body 62 much bites into the elastic layer 51*b* of the heating roll 51, as shown in FIGS. 6, 10, and 11.

On the other hand, the pad member 65 becomes elastically deformed so as to be compressed upon reception of reaction force of the elastic layer 51*b* of the heating roll 51; since the projection part 64*a* of the head member 64 is formed with the slope 67, an end part 65*e* downstream in the passage direction B of the record medium 9 enters the space existing between the slope 67 and the heating roll 51 in deformation. Accordingly, the pad member 65 becomes deformed to a shape almost following the shape of the outer peripheral surface of the heating roll 51 in the press contact part portion NPb.

Therefore, as the shape of the elastic layer 51*b* of the heating roll 51 when the press contact part NP is passed through, much bites into the flat part 64*a*-1 of the projection part 64*a* of the head member 64 much bites into the elastic layer 51*b* in the press contact part portion NPa formed in the head member 64, and the shape becomes a recessed shape of curvature opposite to the outer peripheral surface of the heating roll 51.

Accordingly, when a bag-shaped record medium 9A such as an envelope passes through the press contact part NP, the move speed difference in the surface and the back is canceled out and lessens. Consequently, in the bag-shaped record medium 9A when passing through the press contact part NP, the percentage of the bag-shaped record medium 9A passing through and conveyed with a shift caused by the move speed difference between the surface part 91 and the back part 92 lessens and thus occurrence of a wrinkle is suppressed.

Figure 12:
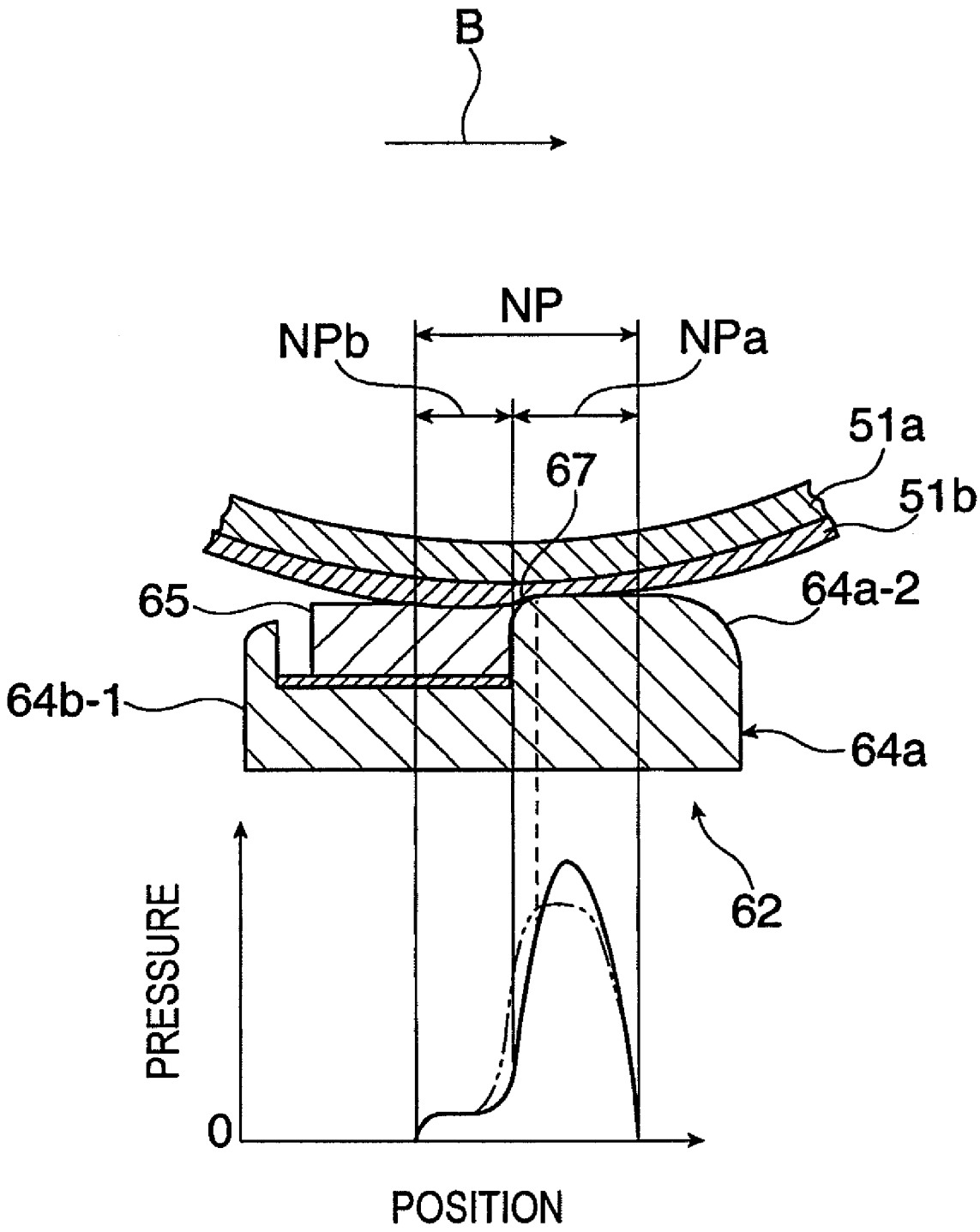
FIG. 12 is a schematic representation to show the press contact part in FIG. 11, a pressure distribution, etc.

FIG. 12 shows a pressure distribution state in the press contact part NP. In the press contact part NP, the pressure in the press contact part portion NPa formed in the head member 64 becomes relatively larger than the pressure in the press contact part portion NPb formed in the pad member 65. However, also in the press contact part portion NPa, the pressure of an end part upstream in the passage direction B of the record medium forming the slope 67 of the head member 64 tends to become rapidly small. The alternate long and two short dashes line in the figure indicates a pressure distribution when a slope (67) is not formed in the end part upstream in the passage direction B of the record medium of the head member 64.

Thus, according to the fixing unit 4, an image can also be well fixed on the bag-shaped record medium 9A such as an envelope with occurrence of a wrinkle suppressed. The image forming apparatus 1 using the fixing unit 4 makes it possible to form a good image with no fixing failure caused by wrinkle occurrence or degradation of the fixing performance.

FIGS. 14 and 15 show the results of evaluation tests 1 and 2 relating to the move (conveying) speed difference for a bag-shaped record medium (envelope) conducted using the fixing unit 4.

The conditions of the fixing unit 4 used in evaluation tests 1 and 2 are as follows: As the heating roll 51, a heating roll having a metal cylindrical roll base material having an outer diameter of 21 mm formed with an elastic layer 51*b* (with a thickness of 0.6 mm) made of silicon rubber (JIS-A rubber hardness: 40 degrees) was used. As the endless belt 61, a polyimide belt (with a thickness of 60 μm) having an outer diameter of 30 mm was used. As the head member 64, a member formed of a molded article made of a liquid crystal polymer as a whole where the width of the flat part 64*a*-1 of the projection part 64*a* is 1 to 2 mm and the height h of the projection part 64*a* from the installation face 64*b*-1 of the retention part 64*b* is 3 mm was used. As the pad member 64, a member made of silicon rubber (askar C (9.8 N) hardness: 24 degrees) and shaped like a square bar having a width (length along the passage direction B) of 5 mm and a thickness in the range of 3.5 to 4.2 mm was used.

In the fixing unit 4, the pressing body 62 of the head member 64 and the pad member 65 pressed the endless belt 61 against the heating roll 51 under a load of 170 N to form the press contact part NP. The heating roll 51 was rotated at speed (10 sheets/minute) of about a half of ordinary rotation speed and heats with the surface temperature kept at 190° C.

Since the fixing unit 4 adopts the center registration system, a 120-mm area portion was reserved in the center part of the fix set area E (whole width 220 mm) as the specific fix area E1 of the press contact part NP. As the head member 64, a member formed with the slope (67) shown in FIG. 14, etc., in the end part downstream in the passage direction B was used to form each press contact part NP. The slope 67 was formed in all area of the fix set area E (E1+E2+E3). "R1.0" and "R0.5" concerning the slope in the figure indicate curved surfaces with curvatures 1.0 mm and 0.5 mm as shown 67A in FIG. 9. "C0.5" indicates a flat face corresponding to the diagonal line of a square having each side of 0.5 mm as shown 67B in FIG. 13. For comparison, a fixing unit (comparison example) with a press contact part NP formed using a head member 64 having edge parts crossing almost at right angle without forming a slope was provided.

The press contact part NP ranges from the point where the pad member 65 starts to come in contact with the outer peripheral surface of the heating roll 51 through the endless belt 61 to the point where the head member 64 is brought away from contact with the outer peripheral surface of the heating roll 51 through the endless belt 61. In the test, the width of each press contact part NPa, NPb (length S1, S2) was found by measuring the width of a fix unevenness portion (length of passage direction B) in a solid image when a record medium 9 (ordinary sheet of paper) previously formed with the solid image was introduced into the press contact part NP of the fixing unit 4 and was stopped at a midpoint of passage.

In evaluation tests 1 and 2, an envelope was used as the bag-shaped record medium 9A and was allowed to pass through the press contact part NP. The (trailing end) shift amount in the trailing end part upstream in the passage direction B of the surface paper sheet and the back paper sheet of the envelope was measured. And the shift amount in the center part in the axial direction A (direction almost orthogonal to the passage direction B) of the heating roll 51 of the surface paper sheet and the back paper sheet of the envelope was measured. The evaluation tests were conducted in an environment of temperature 22° C. and humidity 31%.

Figure 17:
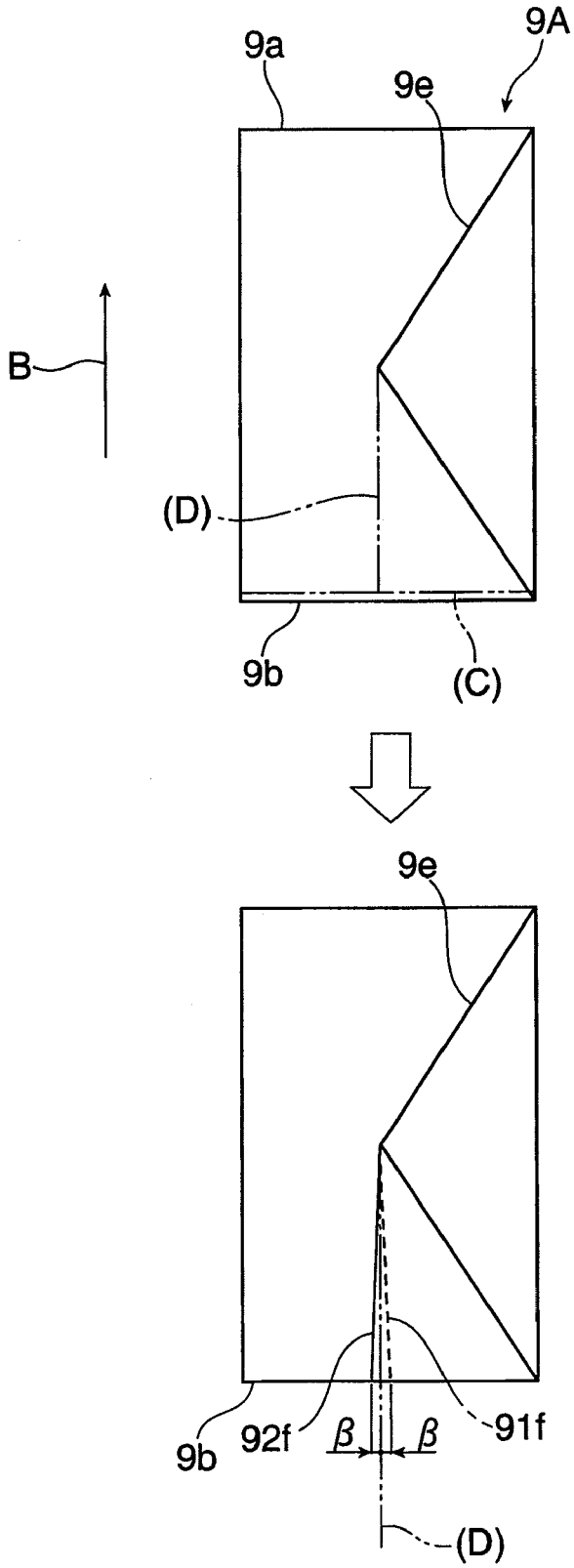
FIG. 17 is a schematic representation to show the work state of an envelope used in evaluation test 2 and measurement.

As the envelope as the bag-shaped record medium 9A, a lidded envelope (manufactured by Columbia, shape: Com-10: Model number: CO131) was used. The feed width when the envelope was passed through the press contact part NP is 105 mm. In evaluation test 1, as the envelope, the upstream end part 9*b* in the passage (conveying) direction B of envelope 9A and folds of both left and right end parts 9*c* and 9*d* were cut to make the trailing end part a free end, as shown in the upper portion of FIG. 16. In evaluation test 2, as the envelope, the upstream end part 9*b* in the passage (conveying) direction B of envelope 9A were cut to make a free end and a notch was made from the center part of the end part 9*b* to the center part downstream in the passage direction B, as shown in the upper portion of FIG. 17. Alternate long and two short dashes line C in each figure indicates the cut end part and alternate long and two short dashes line D in each figure indicates the notch. A lid (flap) 9*e* was pasted with the envelope closed in each case.

In evaluation test 1, a toner image of an address was formed on the surface paper sheet 91 of the cut envelope (FIG. 16) and the envelope was passed through the press contact part NP of the fixing unit 4 in a state in which the connected end part is at the leading end and was discharged. At this time, the envelope was conveyed separately in the following two cases: The envelope was conveyed in a state in which the lid part (flap) 9*e* was positioned on the end part side (drive side) where a drive gear of the heating roll 51 was attached (conveying state: D) and was conveyed in a state in which the lid part (flap) 9*e* was positioned on the opposite side to the drive side (conveying state: AD). For the envelope after it was passed through in each conveying state, shift amount (8) between the surface paper sheet 91 and the back paper sheet 92 in the trailing end part 9*b* was measured, as shown in the lower portion of FIG. 16.

FIG. 14 shows the result of evaluation test 1. Indication of "minus" in the shift amount in FIG. 14 means the case where the trailing end part of the back paper sheet is delivered earlier than the trailing end part of the surface paper sheet of the envelope 9A and a shift occurs. Evaluation test 1 was conducted twice. The larger measurement value of the shift amount (6) obtained in each time is indicated. It is considered that the smaller the numeric value (absolute value) of the shift amount, the smaller the conveying speed difference between the surface paper sheet and the back paper sheet of the envelope.

In evaluation test 2, a toner image of an address was formed on the surface paper sheet 91 of the cut envelope (FIG. 17) and the envelope was passed through the press contact part NP of the fixing unit 4 in a state in which the connected end part is at the leading end and was discharged. At this time, the envelope was conveyed under similar conditions to those of evaluation test 1. For the envelope after it was passed through in each conveying state, shift amounts (β) of a notch surface paper sheet portion 91*f* and a notch back paper sheet portion 92*f* relative to a notch line D were measured, as shown in the lower portion of FIG. 17.

FIG. 15 shows the result of evaluation test 2. In FIG. 15, "surface shift" means the shift amount of the notch surface paper sheet portion 91*f*, and "back shift" means the shift amount of the notch back paper sheet portion 92*f*. In the surface shift and the back shift, indication of "plus" means the shift amount when a move was made so as to open to the outside relative to the notch line D and a shift occurred, and indication of "minus" means the shift amount when a move was made so as to cross the notch line D and close and a shift occurs. Like evaluation test 1, evaluation test 2 was also conducted twice. The larger measurement value of the shift amount (13) obtained in each time is indicated.

As evaluation test 3, an intact envelope 9A with no cut and with no notch was allowed to pass through each fixing unit of each example and the wrinkle suppression effect at the time was examined.

Figure 21:
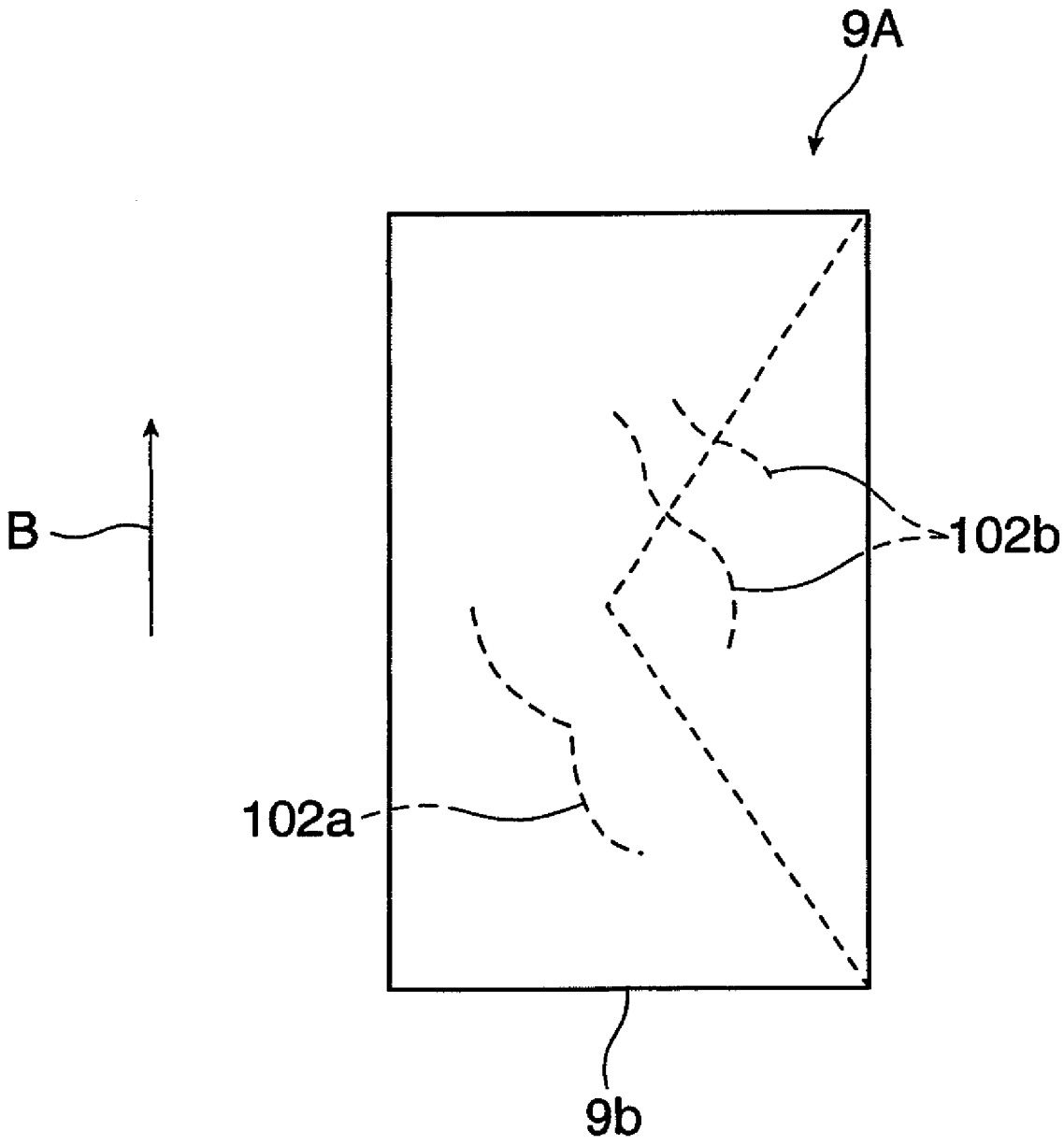
FIG. 21 is a schematic representation to show an example of a center wrinkle occurring on a bag-shaped record medium.

As a result, in examples with slope "R0.5" and slope "C0.5," occurrence of end wrinkles 101 (see FIG. 20) in the end part 9*b* of the envelope 9A was scarcely recognized; however, it was recognized that unnecessary wrinkles (also called "center wrinkles") 102 occurred in an area on the center side in the passage direction B of the envelope 9A as shown in FIG. 21. A center wrinkle 102*a* shown in FIG. 21 is deep and large. Center wrinkles 102*b* shown in FIG. 21 are shallow and narrow. On the other hand, in example with slope "R1.0," it was recognized that occurrence of both an end part wrinkle 101 and a center part wrinkle 102 was suppressed. In this connection, in the example with slope "R1.0," the conveying speed difference between the surface and back portions of the bag-shaped record medium 9A such as an envelope in the specific fix area E1 exists a little and is not complete zero. Such a configuration becomes effective to provide the effect of suppressing occurrence of a center wrinkle if the pressure of each of both end parts of the fix set area E of the press contact part NP (areas containing E2 and E3) is set higher than the pressure of the center area (E1).

In the embodiment described above, the press contact part NP of the fixing unit 4 can be formed in a state in which the center point in the passage direction B of the record medium exists in the area (in the plane) of the slope 67 of the head member 64, as shown in FIGS. 6 and 11. In FIGS. 6 and 11, a dotted line NP-O is a line connecting the center point and a center point O of the heating roll 51.

In such a state, occurrence of unnecessary wrinkles described above is suppressed more reliably.

In the fixing unit 4, a porous elastic member easy to become elastically deformed under a given pressure (for example, a sponge, porous rubber, etc.,) may be used as the pad member 65. In this case, a pad member 65B made of the porous elastic member becomes easier to become elastically deformed upon reception of a reaction force of the elastic layer 51*b* of the heating roll 51 when the press contact part NP is formed, and the shape of the press contact part portion NPb formed of pad member 65B becomes a shape more following the cylindrical periphery of the outer peripheral surface of the heating roll 51.

The specific fix area E1 can also be set as all area of the fix set area E. As the bag-shaped record medium 9A, a record medium of any other type than an envelope can be applied if occurrence of a wrinkle can be suppressed In addition, as the imaging apparatus 2 in the image forming apparatus 1, an imaging apparatus for forming a single-color toner image may be applied. The imaging apparatus 2 may be an imaging apparatus adopting no transfer system.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing unit comprising:

a heating roll that includes an elastic layer;

an endless belt that is in contact with an outer peripheral surface of the heating roll; and a pressing body that presses the endless belt against the outer peripheral surface of the heating roll from an inner peripheral surface side of the endless belt to form a press contact part, wherein the press contact part allows a record medium holding an unfixed image to pass through between the endless belt and the heating roll, and the pressing body comprises:

a hard pressing member that (i) is placed on a downstream side of a passage direction of the record medium in the press contact part and (ii) is formed of higher hardness than the elastic layer of the heating roll; and a soft pressing member that (i) is placed on an upstream side of the passage direction from the hard pressing member, (ii) is formed of lower hardness than the elastic layer of the heating roll, and (iii) is elastically deformed, wherein the hard pressing member has a first press contact portion in the press contact part, the soft pressing member has a second press contact portion in the press contact part, and the press contact part is formed in a state in which the first press contact portion is longer than the second press contact portion, and the hard pressing member has an end part opposed to the heating roll on the upstream side, the end part having a face approaching the heating roll from the upstream side to the downstream side.

2. The fixing unit according to claim 1, wherein the hard pressing member has the face formed of a curved surface projecting to the side of the heating roll.

3. The fixing unit according to claim 1, wherein the press contact part is formed in a state in which the center point in the passage direction of the record medium exists in an area of the face of the hard pressing member.

4. An image forming apparatus comprising:

an imaging apparatus that forms an unfixed image and transfers the image to a record medium; and the fixing unit of claim 1, wherein the fixing unit fixes the unfixed image, transferred by the imaging apparatus, onto the record medium.

* * * * *